US010910722B2

(12) United States Patent
Pance et al.

(10) Patent No.: US 10,910,722 B2
(45) Date of Patent: Feb. 2, 2021

(54) DIELECTRIC RESONATOR ANTENNA HAVING FIRST AND SECOND DIELECTRIC PORTIONS

(71) Applicant: Rogers Corporation, Chandler, AZ (US)

(72) Inventors: Kristi Pance, Auburndale, MA (US); Gianni Taraschi, Arlington, MA (US); Roshin Rose George, Burlington, MA (US)

(73) Assignee: ROGERS CORPORATION, Chandler, AZ (US)

( * ) Notice: Subject to any disclaimer, the term of this patent is extended or adjusted under 35 U.S.C. 154(b) by 40 days.

(21) Appl. No.: 16/246,892

(22) Filed: Jan. 14, 2019

(65) Prior Publication Data

US 2019/0221940 A1 Jul. 18, 2019

Related U.S. Application Data

(60) Provisional application No. 62/633,256, filed on Feb. 21, 2018, provisional application No. 62/617,358, filed on Jan. 15, 2018.

(51) Int. Cl.

| | |
|---|---|
| ***H01Q 9/04*** | (2006.01) |
| ***H01Q 19/18*** | (2006.01) |
| ***H01Q 19/06*** | (2006.01) |
| ***H01Q 21/06*** | (2006.01) |

(52) U.S. Cl.

CPC ..... *H01Q 9/0485* (2013.01); *H01Q 19/18* (2013.01); *H01Q 19/06* (2013.01); *H01Q 21/061* (2013.01)

(58) Field of Classification Search

None

See application file for complete search history.

(56) References Cited

U.S. PATENT DOCUMENTS

| | | | |
|---|---|---|---|
| 2,624,002 | A | 10/1952 | Bouix |
| 3,321,765 | A | 5/1967 | Peters et al. |
| 4,366,484 | A | 12/1982 | Weiss et al. |

(Continued)

FOREIGN PATENT DOCUMENTS

| | | | |
|---|---|---|---|
| EP | 068413 | A2 | 1/1992 |
| EP | 0587247 | A1 | 3/1994 |

(Continued)

OTHER PUBLICATIONS

Buerkle, A. et al; "Fabrication of a DRA Array Using Ceramic Stereolithography"; IEEE Antennas and Wireless Popagation Letters; IEEE; vol. 5 No. 1, Jan. 2007; pp. 479-481.

(Continued)

*Primary Examiner* — Jany Richardson

(74) *Attorney, Agent, or Firm* — Cantor Colburn LLP

(57) ABSTRACT

An electromagnetic device includes: a dielectric structure having: a first dielectric portion, FDP, having a proximal end and a distal end, the FDP having a dielectric material other than air; and a second dielectric portion, SDP, having a proximal end and a distal end, the proximal end of the SDP being disposed proximate the distal end of the FDP, the SDP having a dielectric material other than air; and wherein the dielectric material of the FDP has an average dielectric constant that is greater than the average dielectric constant of the dielectric material of the SDP.

35 Claims, 15 Drawing Sheets

(56) References Cited

U.S. PATENT DOCUMENTS 4,743,915 A 5/1988 Rammos et al.
5,227,749 A 7/1993 Raguenet et al.
5,453,754 A 9/1995 Fray
5,589,842 A 12/1996 Wang et al.
5,667,796 A 9/1997 Otten
5,854,608 A 12/1998 Leisten
5,940,036 A 8/1999 Oliver et al.
5,952,972 A 9/1999 Ittipiboon et al.
6,031,433 A 2/2000 Tanizaki et al.
6,052,087 A 4/2000 Ishikawa et al.
6,061,026 A 5/2000 Ochi et al.
6,061,031 A 5/2000 Cosenza et al.
6,147,647 A 11/2000 Tassoudji et al.
6,181,297 B1 1/2001 Leisten
6,188,360 B1 2/2001 Kato et al.
6,198,450 B1 * 3/2001 Adachi ..... H01Q 9/0485 343/753
6,268,833 B1 7/2001 Tanizaki et al.
6,292,141 B1 9/2001 Lim
6,314,276 B1 11/2001 Hilgers et al.
6,317,095 B1 11/2001 Teshirogi et al.
6,323,808 B1 11/2001 Heinrichs et al.
6,323,824 B1 11/2001 Heinrichs et al.
6,344,833 B1 2/2002 Lin et al.
6,373,441 B1 4/2002 Porath et al.
6,437,747 B1 8/2002 Stoiljkovic et al.
6,476,774 B1 11/2002 Davidson et al.
6,528,145 B1 3/2003 Berger et al.
6,552,687 B1 4/2003 Rawnick et al.
6,556,169 B1 4/2003 Fukuura et al.
6,621,381 B1 9/2003 Kundu et al.
6,743,744 B1 6/2004 Kim et al.
6,794,324 B1 9/2004 Kim et al.
6,816,118 B2 11/2004 Kingsley et al.
6,816,128 B1 11/2004 Jennings
7,161,535 B2 1/2007 Palmer et al.
7,179,844 B2 2/2007 Aki et al.
7,183,975 B2 2/2007 Thomas et al.
7,196,663 B2 3/2007 Bozer et al.
7,253,789 B2 8/2007 Kingsley et al.
7,292,204 B1 11/2007 Chang et al.
7,310,031 B2 12/2007 Pance et al.
7,379,030 B1 5/2008 Lier
7,382,322 B1 6/2008 Yang et al.
7,443,363 B2 10/2008 Ying
7,498,969 B1 3/2009 Paulsen et al.
7,545,327 B2 6/2009 Iellici et al.
7,570,219 B1 8/2009 Paulsen et al.
7,595,765 B1 9/2009 Hirsch et al.
7,636,063 B2 12/2009 Channabasappa
7,663,553 B2 2/2010 Chang et al.
7,710,325 B2 5/2010 Cheng
7,961,148 B2 6/2011 Goldberger
8,098,197 B1 1/2012 Herting et al.
8,498,539 B1 7/2013 Iichenko et al.
8,736,502 B1 5/2014 Langfield et al.
8,773,319 B1 7/2014 Anderson et al.
8,902,115 B1 12/2014 Loui et al.
9,112,273 B2 8/2015 Christie et al.
9,184,697 B2 11/2015 Sekiguchi et al.
9,225,070 B1 12/2015 Zeweri et al.
9,608,330 B2 3/2017 Singleton et al.
9,825,373 B1 11/2017 Smith
10,355,361 B2 7/2019 Pance et al.
10,522,917 B2 12/2019 Pance et al.
10,587,039 B2 3/2020 Pance et al.
2001/0013842 A1 8/2001 Ishikawa et al.
2001/0043158 A1 11/2001 Adachi et al.
2002/0000947 A1 1/2002 Al-Rawi et al.
2002/0057138 A1 5/2002 Takagi et al.
2002/0180646 A1 12/2002 Kivekas et al.
2002/0196190 A1 12/2002 Lim
2003/0016176 A1 1/2003 Kingsley et al.
2003/0034922 A1 2/2003 Isaacs et al.
2003/0043075 A1 * 3/2003 Bit-Babik ..... H01Q 9/0485 343/700 MS
2003/0122729 A1 7/2003 Diaz et al.
2003/0151548 A1 8/2003 Kingsley et al.
2003/0181312 A1 9/2003 Mailadil et al.
2004/0029709 A1 2/2004 Oba et al.
2004/0036148 A1 2/2004 Block et al.
2004/0051602 A1 3/2004 Pance et al.
2004/0080455 A1 4/2004 Lee
2004/0113843 A1 6/2004 Le Bolzer et al.
2004/0119646 A1 6/2004 Ohno et al.
2004/0127248 A1 7/2004 Lin et al.
2004/0130489 A1 7/2004 Le Bolzer et al.
2004/0155817 A1 8/2004 Kingsley et al.
2004/0233107 A1 11/2004 Popov et al.
2004/0263422 A1 12/2004 Lynch
2005/0017903 A1 1/2005 Ittipiboon et al.
2005/0024271 A1 2/2005 Ying et al.
2005/0057402 A1 3/2005 Ohno et al.
2005/0099348 A1 5/2005 Pendry
2005/0122273 A1 6/2005 Legay et al.
2005/0162316 A1 7/2005 Thomas et al.
2005/0179598 A1 8/2005 Legay et al.
2005/0200531 A1 9/2005 Huang et al.
2005/0219130 A1 10/2005 Koch et al.
2005/0225499 A1 10/2005 Kingsley et al.
2005/0242996 A1 11/2005 Palmer et al.
2005/0264449 A1 12/2005 Strickland
2005/0264451 A1 12/2005 Aikawa et al.
2006/0022875 A1 2/2006 Pidwerbetsky et al.
2006/0119518 A1 6/2006 Ohmi et al.
2006/0145705 A1 7/2006 Raja
2006/0194690 A1 8/2006 Osuzu
2006/0232474 A1 10/2006 Fox
2006/0293651 A1 12/2006 Cronin
2007/0152884 A1 7/2007 Bouche et al.
2007/0164420 A1 7/2007 Chen et al.
2007/0252778 A1 11/2007 Ide et al.
2008/0036675 A1 2/2008 Fujieda
2008/0042903 A1 2/2008 Cheng
2008/0048915 A1 2/2008 Chang et al.
2008/0094309 A1 4/2008 Pance et al.
2008/0122703 A1 5/2008 Ying
2008/0129616 A1 6/2008 Li et al.
2008/0129617 A1 6/2008 Li et al.
2008/0260323 A1 10/2008 Jalali et al.
2008/0272963 A1 11/2008 Chang et al.
2008/0278378 A1 11/2008 Chang et al.
2009/0040131 A1 2/2009 Mosallaei
2009/0073332 A1 3/2009 Irie
2009/0102739 A1 4/2009 Chang et al.
2009/0128262 A1 5/2009 Lee et al.
2009/0128434 A1 5/2009 Chang et al.
2009/0140944 A1 6/2009 Chang et al.
2009/0153403 A1 6/2009 Chang et al.
2009/0179810 A1 7/2009 Kato et al.
2009/0184875 A1 7/2009 Chang et al.
2009/0206957 A1 8/2009 Hiroshima et al.
2009/0262022 A1 10/2009 Ying
2009/0270244 A1 10/2009 Chen et al.
2009/0305652 A1 12/2009 Boffa et al.
2010/0051340 A1 3/2010 Yang et al.
2010/0103052 A1 4/2010 Ying
2010/0220024 A1 9/2010 Snow et al.
2011/0012807 A1 1/2011 Sorvala
2011/0050367 A1 3/2011 Yen et al.
2011/0121258 A1 5/2011 Hanein et al.
2011/0122036 A1 5/2011 Leung et al.
2011/0133991 A1 6/2011 Lee et al.
2011/0248890 A1 10/2011 Lee et al.
2012/0092219 A1 4/2012 Kim
2012/0212386 A1 8/2012 Massie et al.
2012/0242553 A1 9/2012 Leung et al.
2012/0245016 A1 9/2012 Curry et al.
2012/0256796 A1 10/2012 Leiba
2012/0274523 A1 11/2012 Ayatollahi
2012/0276311 A1 11/2012 Chirila
2012/0287008 A1 11/2012 Kim
2012/0306713 A1 12/2012 Raj et al.

(56) References Cited

U.S. PATENT DOCUMENTS

| | | | |
|---|---|---|---|
| 2012/0329635 | A1 | 12/2012 | Hill |
| 2013/0076570 | A1 | 3/2013 | Lee et al. |
| 2013/0088396 | A1 | 4/2013 | Han |
| 2013/0113674 | A1 | 5/2013 | Ryu |
| 2013/0120193 | A1 | 5/2013 | Hoppe et al. |
| 2013/0234898 | A1 | 9/2013 | Leung et al. |
| 2013/0278610 | A1 | 10/2013 | Stephanou et al. |
| 2014/0043189 | A1 | 2/2014 | Lee et al. |
| 2014/0327591 | A1 | 11/2014 | Kokkinos |
| 2014/0327597 | A1 | 11/2014 | Rashidian et al. |
| 2015/0035714 | A1 | 2/2015 | Zhou |
| 2015/0077198 | A1 | 3/2015 | Yatabe |
| 2015/0138036 | A1 | 4/2015 | Harper |
| 2015/0207233 | A1 | 7/2015 | Kim et al. |
| 2015/0207234 | A1 | 7/2015 | Ganchrow et al. |
| 2015/0236428 | A1 | 8/2015 | Caratelli et al. |
| 2015/0244082 | A1 | 8/2015 | Caratelli et al. |
| 2015/0303546 | A1 | 10/2015 | Rashidian et al. |
| 2015/0314526 | A1 | 11/2015 | Cohen |
| 2015/0346334 | A1 | 12/2015 | Nagaishi et al. |
| 2015/0380824 | A1 | 12/2015 | Tayfeh Aligodarz et al. |
| 2016/0111769 | A1 | 4/2016 | Pance et al. |
| 2016/0218437 | A1 | 7/2016 | Guntupalli et al. |
| 2016/0294066 | A1 | 10/2016 | Djerafi et al. |
| 2016/0294068 | A1 | 10/2016 | Djerafi et al. |
| 2016/0322708 | A1 | 11/2016 | Tayfeh Aligodarz et al. |
| 2016/0351996 | A1 | 12/2016 | Ou |
| 2016/0372955 | A1 | 12/2016 | Fackelmeier et al. |
| 2017/0018851 | A1 | 1/2017 | Henry et al. |
| 2017/0040700 | A1 | 2/2017 | Leung et al. |
| 2017/0125901 | A1 | 5/2017 | Sharawi et al. |
| 2017/0125908 | A1 | 5/2017 | Pance et al. |
| 2017/0125909 | A1 | 5/2017 | Pance et al. |
| 2017/0125910 | A1 | 5/2017 | Pance et al. |
| 2017/0179569 | A1 | 6/2017 | Kim et al. |
| 2017/0188874 | A1 | 7/2017 | Suhami |
| 2017/0271772 | A1 | 9/2017 | Miraftab et al. |
| 2017/0272149 | A1 | 9/2017 | Michaels |
| 2018/0115072 | A1 | 4/2018 | Pance et al. |
| 2018/0309202 | A1 | 10/2018 | Pance et al. |
| 2018/0323514 | A1 | 11/2018 | Pance et al. |
| 2019/0020105 | A1 | 1/2019 | Pance et al. |
| 2019/0214732 | A1 | 7/2019 | Leung et al. |
| 2019/0319357 | A1 | 10/2019 | Pance et al. |
| 2019/0379123 | A1 | 12/2019 | Leung et al. |
| 2019/0393607 | A1 | 12/2019 | Pance et al. |
| 2020/0083609 | A1 | 3/2020 | Pance et al. |

FOREIGN PATENT DOCUMENTS

| | | | |
|---|---|---|---|
| EP | 0801436 | A2 | 10/1997 |
| EP | 1783516 | A1 | 5/2007 |
| EP | 2905632 | A1 | 8/2015 |
| JP | 2004112131 | A | 4/2004 |
| WO | 2017075184 | A1 | 5/2017 |

OTHER PUBLICATIONS

Guo, Yomg-Xin, et al.,; "Wide-Band Stacked Double Annular-Ring Dielectric Resonator Antenna at the End-Fire Mode Operation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6; No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

Kishk, A. Ahmed, et al.,; "Analysis of Dielectric-Resonator with Emphasis on Hemispherical Structures"; IEEE Antennas & Propagation Magazine; vol. 36; No. 2; Apr. 1994; 20-31 pages.

Zainud-Deen, S H et al; "Dielectric Resonator Antenna Phased Array for Fixed RFID Reader in Near Field Region"; IEEE; Mar. 6, 2012; pp. 102-107.

Notification of Transmittal of the International Search Report and the Written Opinion of the Internation Searching Authority, or the Declartion of International Application No. PCT/US2019/013577; Report dated Mar. 27, 2019; Report dated Apr. 3, 2019; 18 pages.

Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.

Ruan, Yu-Feng, et al; "Antenna Effects Consideration for Space-Time Coding UWB-Impulse Radio System in IEEE 802.15 Multipath Channel"; Wireless Communications, Networking and Mobile Computing; 2006; 1-4 pages.

Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.

* cited by examiner

DIELECTRIC RESONATOR ANTENNA HAVING FIRST AND SECOND DIELECTRIC PORTIONS

CROSS REFERENCE TO RELATED APPLICATIONS

This application claims the benefit of U.S. Provisional Application Ser. No. 62/633,256, filed Feb. 21, 2018, which is incorporated herein by reference in its entirety. This application also claims the benefit of U.S. Provisional Application Ser. No. 62/617,358, filed Jan. 15, 2018, which is incorporated herein by reference in its entirety.

BACKGROUND OF THE INVENTION

The present disclosure relates generally to an electromagnetic device, particularly to a dielectric resonator antenna (DRA) system, and more particularly to a DRA system having first and second dielectric portions for enhancing the gain, return loss and isolation associated with a plurality of dielectric structures within the DRA system.

While existing DRA resonators and arrays may be suitable for their intended purpose, the art of DRAs would be advanced with an improved DRA structure for building a high gain DRA system with high directionality in the far field that can overcome existing drawbacks, such as limited bandwidth, limited efficiency, limited gain, limited directionality, or complex fabrication techniques, for example.

BRIEF DESCRIPTION OF THE INVENTION

An embodiment includes an electromagnetic device having: a dielectric structure that includes: a first dielectric portion, FDP, having a proximal end and a distal end, the FDP having a dielectric material other than air; and a second dielectric portion, SDP, having a proximal end and a distal end, the proximal end of the SDP being disposed proximate the distal end of the FDP, the SDP having a dielectric material other than air; and wherein the dielectric material of the FDP has an average dielectric constant that is greater than the average dielectric constant of the dielectric material of the SDP.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the claims. Accordingly, the following example embodiments are set forth without any loss of generality to, and without imposing limitations upon, the claimed invention.

An embodiment, as shown and described by the various figures and accompanying text, provides an electromagnetic device in the form of a dielectric structure having a first dielectric portion and a second dielectric portion strategically disposed with respect to the first dielectric portion so as to provide for improved gain, improved bandwidth, improved return loss, and/or improved isolation, when at least the first dielectric portion is electromagnetically excited to radiate (e.g., electromagnetically resonate and radiate) an electromagnetic field in the far field. In an embodiment, only the first dielectric portion is electromagnetically excited to radiate an electromagnetic field in the far field. In another embodiment, both the first dielectric portion and the second dielectric portion are electromagnetically excited to radiate an electromagnetic field in the far field. In an embodiment where only the first dielectric portion is electromagnetically excited to radiate an electromagnetic field in the far field, the first dielectric portion may be viewed as an electromagnetic dielectric resonator, and the second dielectric portion may be viewed as a dielectric electromagnetic beam shaper. In an embodiment where both the first dielectric portion and the second dielectric portion are electromagnetically excited to radiate an electromagnetic field in the far field, the combination of the first dielectric portion and the second dielectric portion may be viewed as an electromagnetic dielectric resonator, and where the second dielectric portion may also be viewed as a dielectric electromagnetic beam shaper. In an embodiment, the dielectric structure is an all-dielectric structure (absent embedded metal or metal particles, for example).

Figure 1A:
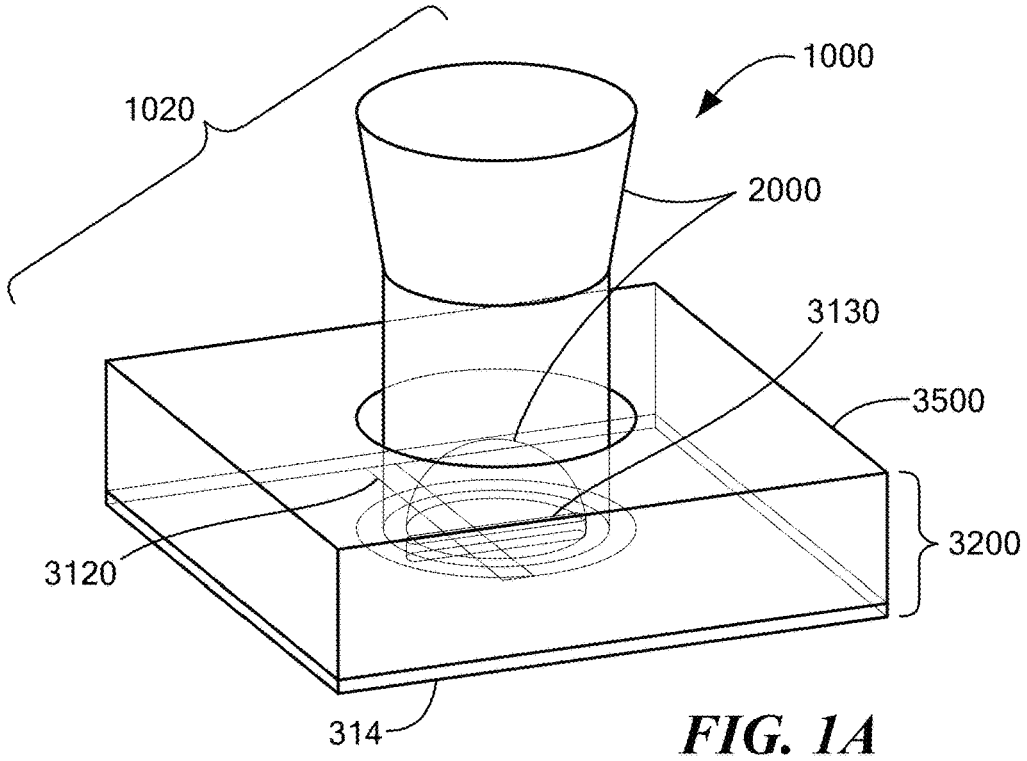
FIG. 1A depicts a rotated perspective view of a unit cell of an electromagnetic, EM, device, in accordance with an embodiment.
Figure 1B:
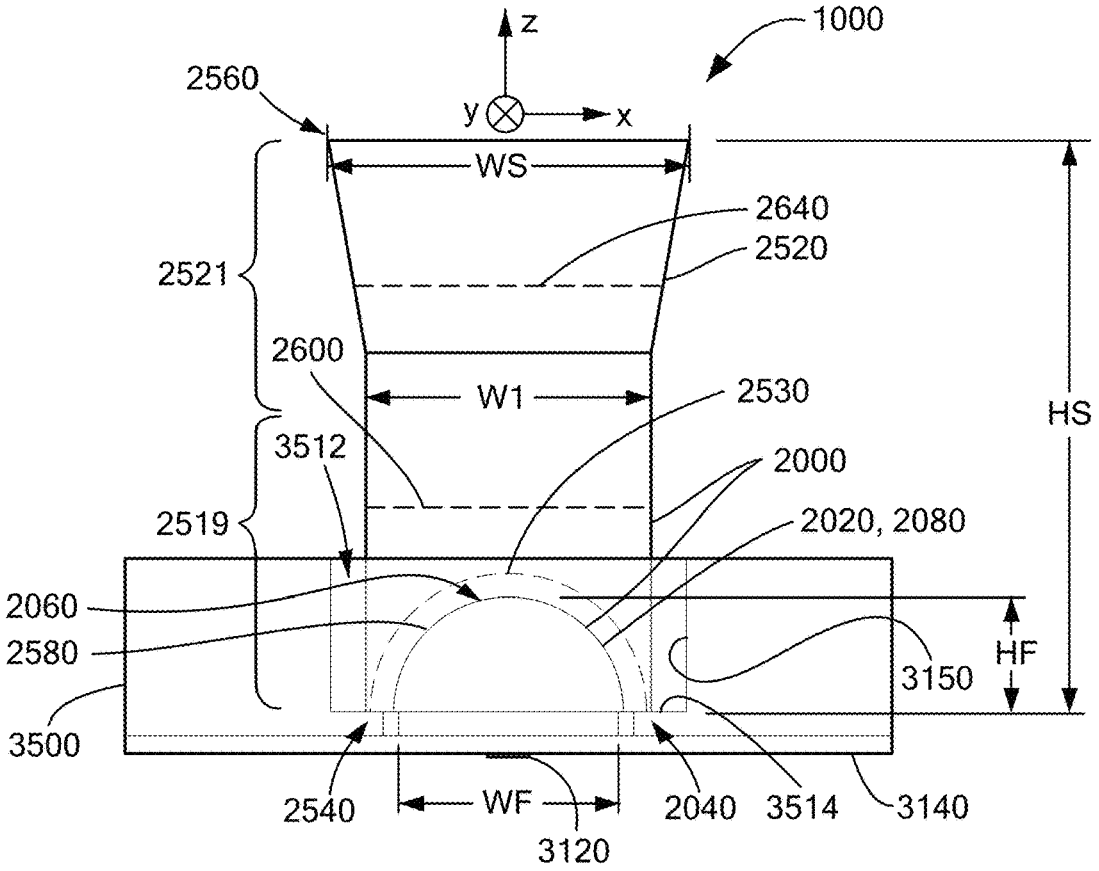
FIG. 1B depicts a side view of the unit cell of FIG. 1A, in accordance with an embodiment.

FIGS. 1A and 1B depict an electromagnetic, EM, device 1000 having a dielectric structure 2000 composed of a first dielectric portion 2020 and a second dielectric portion 2520. The first dielectric portion 2020 has a proximal end 2040 and a distal end 2060, and a three-dimensional, 3D, shape 2080 having a direction of protuberance from the proximal end 2040 to the distal end 2060 oriented parallel with a z-axis of an orthogonal x, y, z coordinate system. For purposes disclosed herein, the z-axis of the orthogonal x, y, z coordinate system is aligned with and is coincidental with a central vertical axis of an associated first dielectric portion 2020, with the x-z, y-z and x-y planes being oriented as depicted in the various figures, and with the z-axis orthogonal to a substrate of the EM device 1000. That said, it will be appreciated that a rotationally translated orthogonal x', y', z' coordinate system may be employed, where the z'-axis is not orthogonal to a substrate of the EM device 1000. Any and all such orthogonal coordinate systems suitable for a purpose disclosed herein are contemplated and considered fall within the scope of an invention disclosed herein. The first dielectric portion 2020 comprises a dielectric material, Dk material, that is other than air, but in an embodiment may include an internal region of air, vacuum, or other gas suitable for a purpose disclosed herein, when the first dielectric portion 2020 is hollow. In an embodiment, the first dielectric portion 2020 has a 3D shape in the form of a hemispherical dome, or in the form of an elongated dome with vertical side walls and a dome shaped top or distal end 2060, or generally in the form having a convex distal end 2060. In an embodiment, the first dielectric portion 2020 may comprise a layered arrangement of dielectric shells to form the hemispherical dome, with each successive outwardly disposed layer substantially embedding and being in direct contact with an adjacent inwardly disposed layer. The second dielectric portion 2520 has a proximal end 2540 and a distal end 2560, with the proximal end 2540 of the second dielectric portion 2520 being disposed proximate the distal end 2060 of the first dielectric portion 2020 to form the dielectric structure 2000. The second dielectric portion 2520 comprises a dielectric material other than air. The second dielectric portion 2520 has a 3D shape having a first x-y plane cross-section area 2580 proximate the proximal end 2540 of the second dielectric portion 2520, and a second x-y plane cross-section area 2600 between the proximal end 2540 and the distal end 2560 of the second dielectric portion 2520, where the second x-y plane cross section area 2600 is greater than the first x-y plane cross-section area 2580. In an embodiment, the first x-y plane cross-section area 2580 and the second x-y plane cross-section area 2600 are circular, but in some other embodiments may be ovaloid, or any other shape suitable for a purpose disclosed herein. In an embodiment, the second dielectric portion 2520 has a third x-y plane cross-section area 2640 disposed between the second x-y plane cross-section area 2600 and the distal end 2560, where the third x-y plane cross-section area 2640 is greater than the second x-y plane cross-section area 2600. In an embodiment, the distal end 2560 of the second dielectric portion 2520 has is planar. In an embodiment, the dielectric material of the first dielectric portion 2020 has an average dielectric constant that is greater than the average dielectric constant of the dielectric material of the second dielectric portion 2520. In an embodiment, the dielectric structure 2000 is an all-dielectric structure absent embedded metal or metal particles, for example. In an embodiment, the first dielectric portion 2020 is a single dielectric material.

In an embodiment, the dielectric material of the first dielectric portion 2020 has an average dielectric constant equal to or greater than 10, and the dielectric material of the second dielectric portion 2520 has an average dielectric constant equal to or less than 9. Alternatively, the dielectric the material of the first dielectric portion 2020 has an average dielectric constant equal to or greater than 11, and the dielectric material of the second dielectric portion 2520 has an average dielectric constant equal to or less than 5. Further alternatively, the dielectric material of the first dielectric portion 2020 has an average dielectric constant equal to or greater than 12, and the dielectric material of the second dielectric portion 2520 has an average dielectric constant equal to or less than 3. Further alternatively, the dielectric material of the first dielectric portion 2020 has an average dielectric constant equal to or greater than 10 and equal to or less than 20, and the dielectric material of the second dielectric portion 2520 has an average dielectric constant equal to or greater than 2 and equal to or less than 9. Further alternatively, the dielectric material of the first dielectric portion 2020 has an average dielectric constant equal to or greater than 10 and equal to or less than 15, and the dielectric material of the second dielectric portion 2520 has an average dielectric constant equal to or greater than 2 and equal to or less than 5. Further alternatively, the dielectric material of the second dielectric portion 2520 has an average dielectric constant greater than the dielectric constant of air and equal to or less than 9.

In an embodiment, the second dielectric portion 2520 has an overall maximum height, HS, and an overall maximum width, WS, where HS is greater than WS. In an embodiment, HS is equal to or greater than 1.5 times WS. Alternatively in an embodiment, HS is equal to or greater than 2 times WS.

In an embodiment, the first dielectric portion 2020 has an overall maximum height, HF, and an overall maximum width, WF, where HS is greater than HF, and where WS is greater than WF. In an embodiment, HS is greater than 5 times HF, and WS is greater than 1.2 times WF.

In an embodiment, the second dielectric portion 2520 has a first sub-portion 2519 proximate the proximal end 2540, and a second sub-portion 2521 proximate the distal end 2560, where the second x-y plane cross-section area 2600 is contained within the first sub-portion 2519, and the third x-y cross-section area 2640 is contained within the second sub-portion 2521. In an embodiment, the first sub-portion 2519 has a cylindrical 3D shape with diameter W1, and the second sub-portion 2521 has a frustoconical 3D shape with a lower diameter of W1 expanding to an upper diameter of WS, such that WS is greater than W1. In an embodiment, diameter W1 is greater than diameter WF.

Figure 1C:
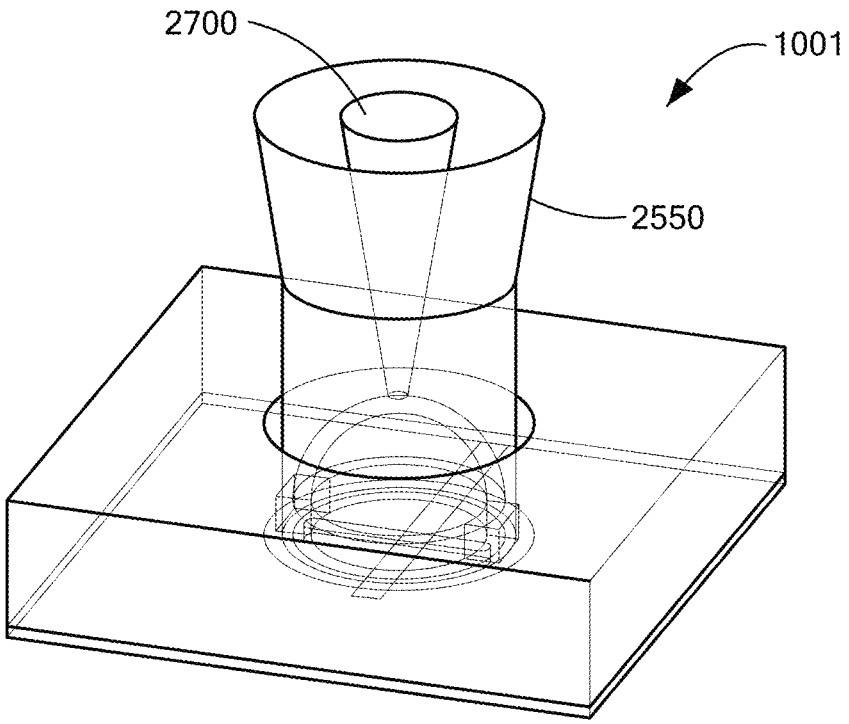
FIG. 1C depicts a rotated perspective view of a unit cell alternative to that depicted in FIG. 1A, in accordance with an embodiment.
Figure 1D:
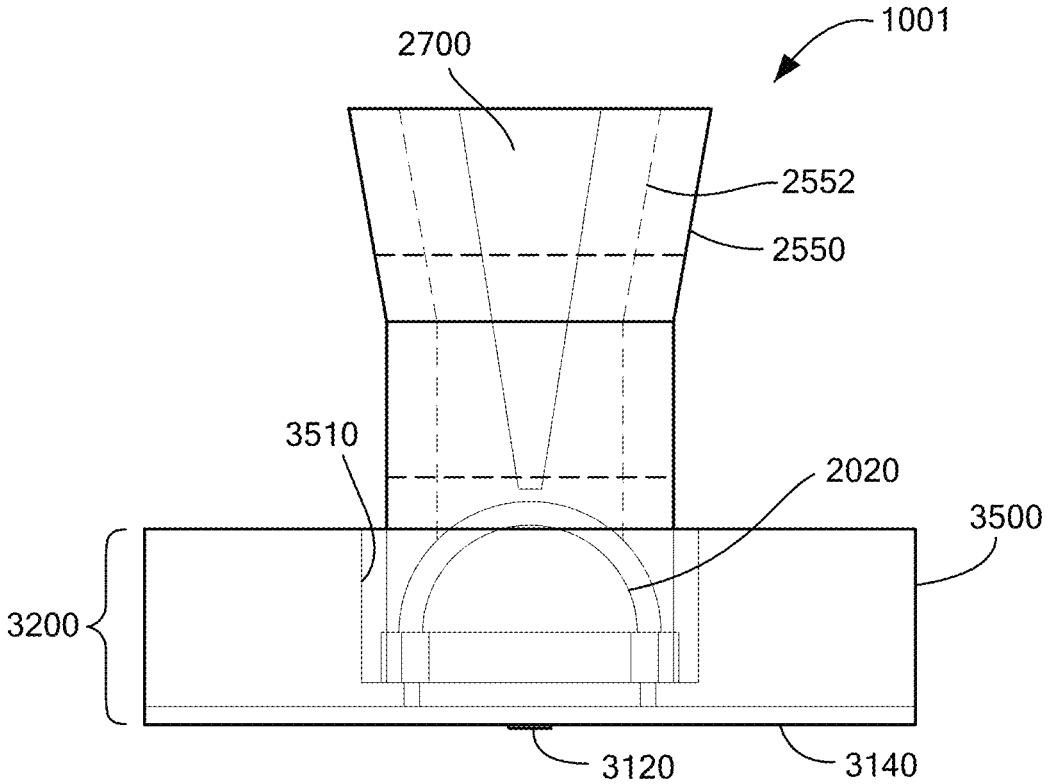
FIG. 1D depicts a side view of the unit cell of FIG. 1C, in accordance with an embodiment.

In an embodiment and with reference now to FIGS. 1C and 1D, an EM device 1001, similar to EM device 1000 where like features are numbered alike, has a second dielectric portion 2550 similar to the second dielectric portion 2520 of FIGS. 1A and 1B, but with an inner region 2700 within the second dielectric portion 2550 that is made from a material having a dielectric constant that is less than the dielectric constant of the remaining outer body portion of the second dielectric portion 2550. In an embodiment, the inner region 2700 is air. Stated generally, the outer body portion of the second dielectric portion 2550 is made from a dielectric material having a first dielectric constant, and the inner region 2700 is made from a dielectric material having a second dielectric constant that is less than the first dielectric constant. Other features of EM device 1001 are similar or identical to those of EM device 1000.

Figure 2:
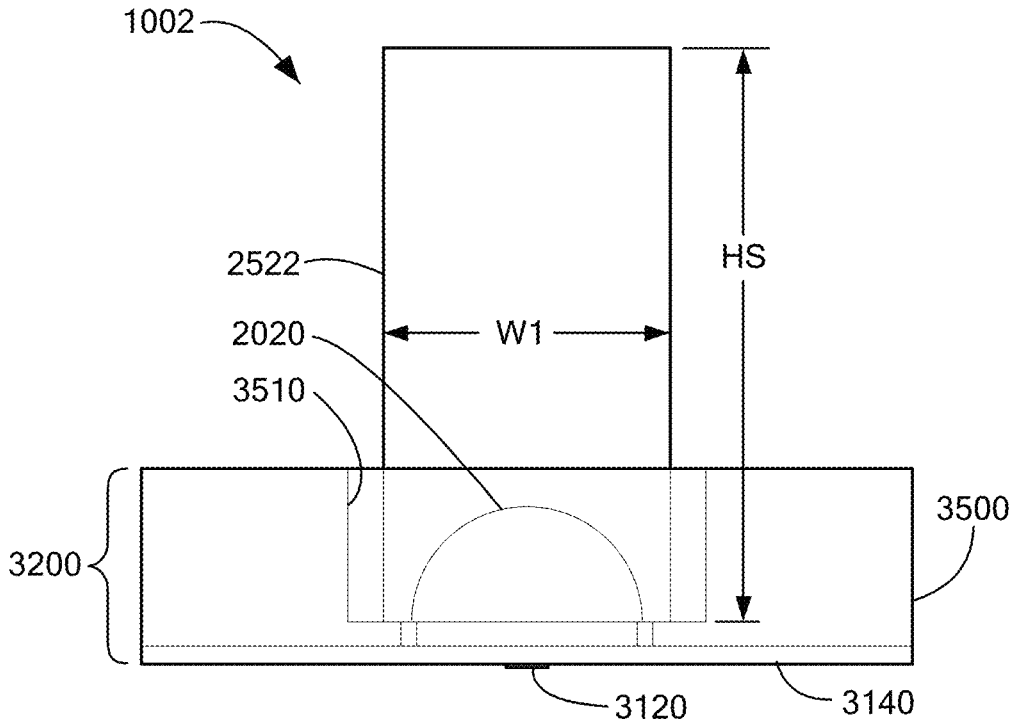
FIG. 2 depicts a side view of a unit cell similar but alternative to that of FIGS. 1B and 1D, in accordance with an embodiment.
Figure 3:
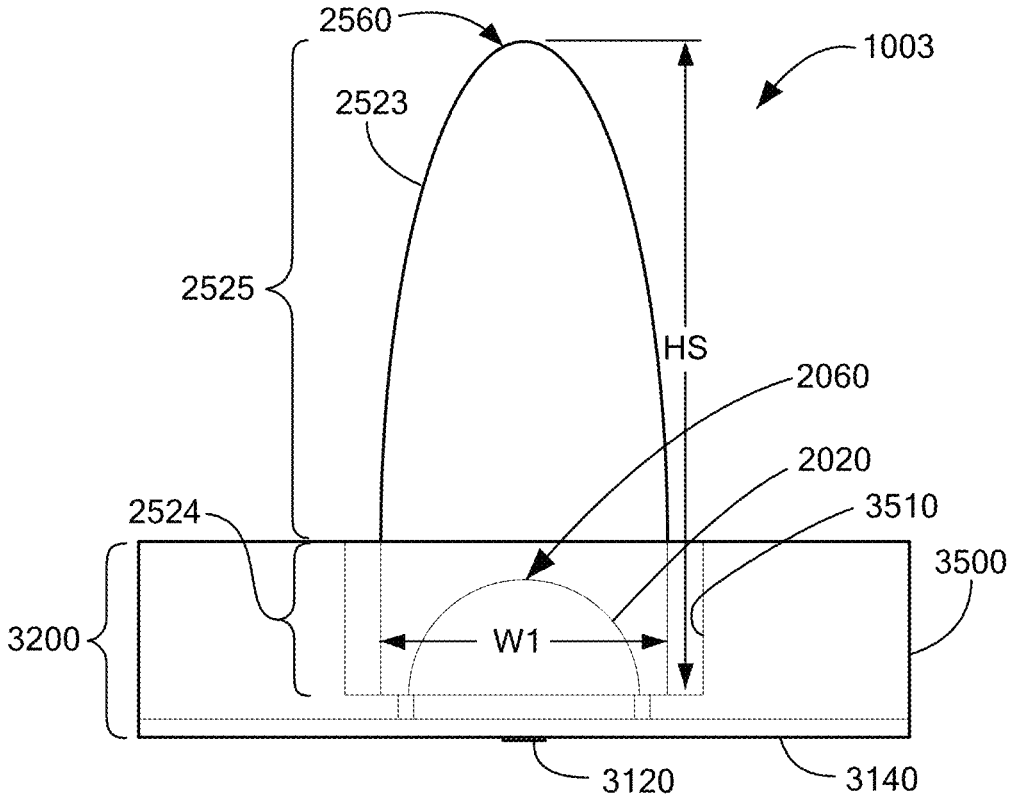
FIG. 3 depicts a side view of a unit cell similar but alternative to that of FIGS. 1B, 1D and 2, in accordance with an embodiment.

Reference is now made to FIGS. 2 and 3, where FIG. 2 depicts an EM device 1002, and FIG. 3 depicts and EM device 1003, and where both EM devices 1002, 1003 are similar to EM device 1000 where like features are numbered alike.

In an embodiment, EM device 1002 depicted in FIG. 2 has a second dielectric portion 2522 similar to the second dielectric portion 2520 of FIGS. 1A and 1B, but with a cylindrical shape having a diameter W1 that extends over the entire height HS of the second dielectric portion 2522. That is, the second dielectric portion 2522 is similar to an extended version of the first sub-portion 2519 of the second dielectric portion 2520 of EM device 1000. In an embodiment, the second dielectric portion 2522 has an overall maximum height, HS, and an overall maximum width, W1, where HS is greater than W1. In an embodiment, HS is equal to or greater than 1.5 times W1. Alternatively in an embodiment, HS is equal to or greater than 2 times W1.

In an embodiment, EM device 1003 depicted in FIG. 3 has a second dielectric portion 2523 having a similar maximum overall width W1 and maximum overall height HS as the second dielectric portion 2522 of EM device 1002, but with a 3D shape a lower portion 2524 with substantially vertical sidewalls, and an upper portion 2525 having a truncated ellipsoidal shape. Comparing FIG. 3 with FIGS. 1A, 1B, 1C, 1D and 2, it can be seen that not only may the first dielectric portion 2020 have a convex distal end 2060, but the second dielectric portion 2523 may also have a convex distal end 2560. In an embodiment, the second dielectric portion 2523 has an overall maximum height, HS, and an overall maximum width, W1, where HS is greater than W1. In an embodiment, HS is equal to or greater than 1.5 times W1. Alternatively in an embodiment, HS is equal to or greater than 2 times W1.

By arranging the height to width ratios of the second dielectric portion 2520, 2521, 2522 as disclosed herein, higher TE (transverse electric) modes are supported, which yields a broader far field TE radiation bandwidth.

In an embodiment, the second dielectric portion 2520, 2521, 2522, 2523 is disposed in direct intimate contact with the first dielectric portion 2020. However, the scope of the invention is not so limited. In an embodiment, the second dielectric portion 2520, 2521, 2522, 2523 is disposed at a distance from the distal end 2060 of the first dielectric portion 2020 that is equal to or less than five times λ, where λ is a freespace wavelength at an operating center frequency of the EM device 1000, depicted by dashed lines 2530 in FIG. 1B. Alternatively, in an embodiment, the second dielectric portion 2520, 2521, 2522, 2523 is disposed at a distance from the distal end 2060 of the first dielectric portion 2020 that is equal to or less than three times λ. Alternatively, in an embodiment, the second dielectric portion 2520, 2521, 2522, 2523 is disposed at a distance from the distal end 2060 of the first dielectric portion 2020 that is equal to or less than two times λ. Alternatively, in an embodiment, the second dielectric portion 2520, 2521, 2522, 2523 is disposed at a distance from the distal end 2060 of the first dielectric portion 2020 that is equal to or less than one times λ. Alternatively, in an embodiment, the second dielectric portion 2520, 2521, 2522, 2523 is disposed at a distance from the distal end 2060 of the first dielectric portion 2020 that is equal to or less than one-half times λ. Alternatively, in an embodiment, the second dielectric portion 2520, 2521, 2522, 2523 is disposed at a distance from the distal end 2060 of the first dielectric portion 2020 that is equal to or less than one-tenth times λ.

Figure 4:
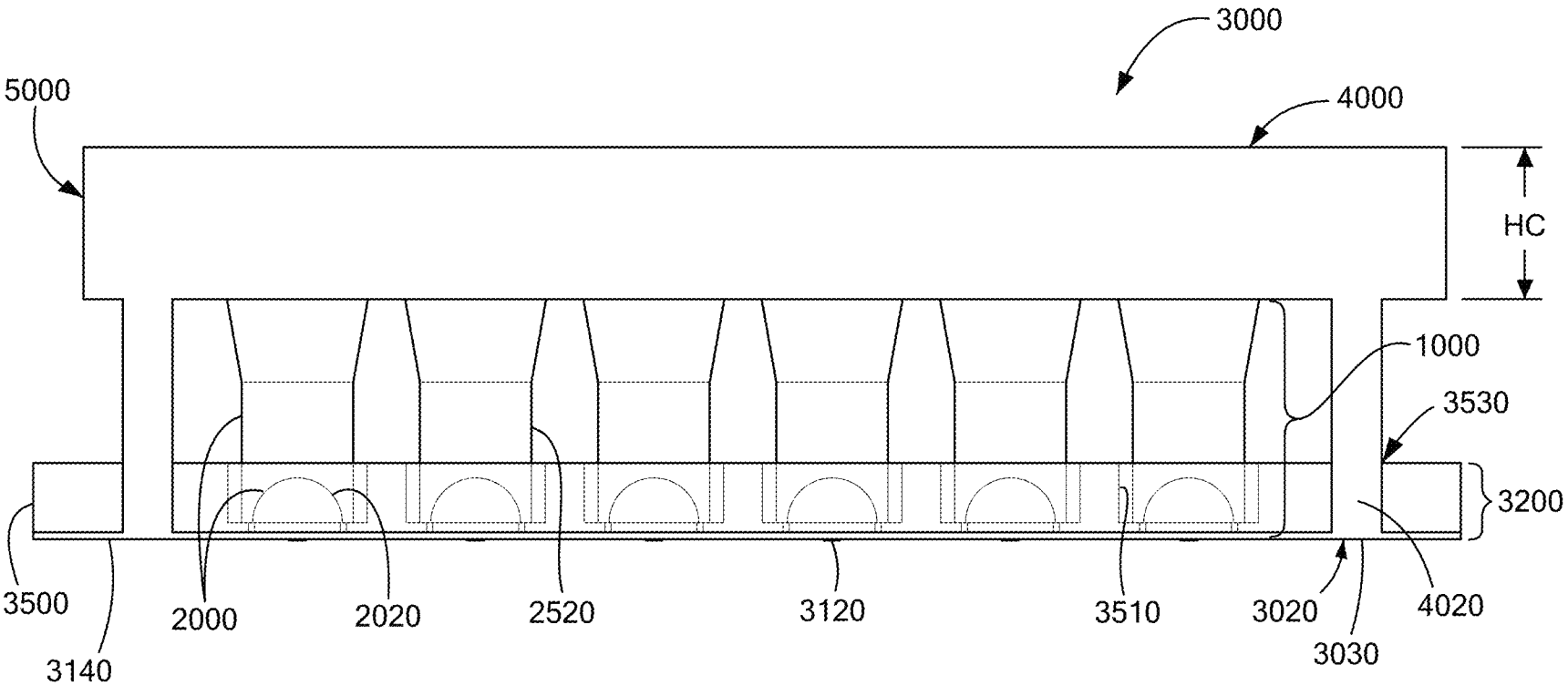
FIG. 4 depicts a side view of an M×N array, where M=6, of a plurality of units cells of FIG. 1B, in accordance with an embodiment.

Reference is now made to FIG. 4, which depicts a plurality of any of the dielectric structures 2000 disclosed herein in an array 3000, where each second dielectric portion 2520, 2521, 2522, 2523 of respective ones of the plurality of dielectric structures 2000 is physically connected to at least one other of the respective second dielectric portions 2520, 2521, 2522, 2523 via a connecting structure 4000. In an embodiment, each connecting structure 4000 is relatively thin (in the plane of the page) as compared to an overall outside dimension, WS or HS for example, of one of the plurality of dielectric structures 2000. In an embodiment, each connecting structure 4000 is formed from a non-gaseous dielectric material, and has a cross sectional overall height HC that is less than an overall height HS of a respective connected dielectric structure 2000. In an embodiment, each connecting structure 4000 and the associated second dielectric portion 2520, 2521, 2522, 2523 forms a single monolithic structure 5000. In an embodiment, each connecting structure 4000 has a cross sectional overall height HC that is less than a free space wavelength λ of a corresponding operating center frequency at which the associated EM device 1000 is operational. In an embodiment, the connecting structure 4000 is formed of a dielectric material that is the same as the dielectric material of the corresponding second dielectric portions 2520, 2521, 2522, 2523. In an embodiment, the connecting structure 4000 and the corresponding second dielectric portions 2520, 2521, 2522, 2523 form the aforementioned single monolithic structure 5000 as a contiguous seamless structure.

With general reference to the aforementioned figures collectively, and with particular reference to FIG. 4, an embodiment of the EM device 1000, 1001, 1002, 1003, or the array 3000 of dielectric structures 2000, further includes a substrate 3200 upon which the individual or the array of dielectric structures 2000 are disposed. In an embodiment, the substrate 3200 includes a dielectric 3140 and a metal fence structure 3500 disposed on the dielectric 3140. With respect to the array 3000 of FIG. 4, the substrate 3200 has at least one support portion 3020, and the connecting structure 4000 has at least one mount portion 4020. In an embodiment, each of the at least one mount portion 4020 is disposed in a one-to-one corresponding relationship with the at least one support portion 3020.

With further general reference to the aforementioned figures collectively, and with particular reference to FIG. 4, an embodiment of the EM device 1000, 1001, 1002, 1003, or the array 3000 of dielectric structures 2000, the metal fence structure 3500 includes a plurality of electrically conductive electromagnetic reflectors 3510 that surround a recess 3512 with an electrically conductive base 3514, each of the plurality of reflectors 3510 being disposed in one-to-one relationship with corresponding ones of the plurality of dielectric structures 2000, and being disposed substantially surrounding each corresponding one of the plurality of dielectric structures 2000. In an embodiment, the metal fence structure 3500 is a unitary metal fence structure, and the plurality of electrically conductive electromagnetic reflectors 3510 are integrally formed with the unitary metal fence structure 3500.

In an embodiment, each respective EM device 1000, 1001, 1002, 1003 includes a signal feed 3120 for electromagnetically exciting a given dielectric structure 2000, where the signal feed 3120 is separated from the metal fence structure 3500 via the dielectric 3140, which in an embodiment is a dielectric medium other than air, and where in an embodiment the signal feed 3120 is a microstrip with slotted aperture 3130 (see FIG. 1A for example). However, excitation of a given dielectric structure 2000 may be provided by any signal feed suitable for a purpose disclosed herein, such as a copper wire, a coaxial cable, a microstrip (e.g., with slotted aperture), a stripline (e.g., with slotted aperture), a waveguide, a surface integrated waveguide, a substrate integrated waveguide, or a conductive ink, for example, that is electromagnetically coupled to the respective dielectric structure 2000. As will be appreciated by one skilled in the art, the phrase electromagnetically coupled is a term of art that refers to an intentional transfer of electromagnetic energy from one location to another without necessarily involving physical contact between the two locations, and in reference to an embodiment disclosed herein more particularly refers to an interaction between a signal source having an electromagnetic resonant frequency that coincides with an electromagnetic resonant mode of the associated dielectric structure 2000. A single one of the combination of a dielectric structure 2000 and a corresponding electromagnetically reflective metal fence structure 3500, as depicted in FIG. 1A for example, is herein referred to as a unit cell 1020.

As depicted in FIG. 4, the dielectric 3140 and the metal fence structure 3500 each have axially aligned through holes 3030, 3530, respectively, that define a location of the at least one support portion 3020 of the substrate 3200. In an embodiment, each of the at least one mount portion 4020 is disposed in a one-to-one correspondence with each of the at least one support portion 3020. In an embodiment, each of the at least one mount portion 4020 is adhered or otherwise fixed to a corresponding one of the at least one support portion 3020. FIG. 4 depicts and M×N array 3000 having a six-wide plurality of dielectric structures 2000 where M=6. In an embodiment, N may equal 6 also, or may equal any number of dielectric structures 2000 suitable for a purpose disclosed herein. Furthermore, it will be appreciated that the number of M×N dielectric structures in a given array as disclosed herein is merely for illustration purposes, and that the values for both M and N may be any number suitable for a purpose disclosed herein. As such, any M×N array falling within the scope of the invention disclosed herein is contemplated.

Reference is now made to FIG. 5A through FIG. 10.

Figure 5B:
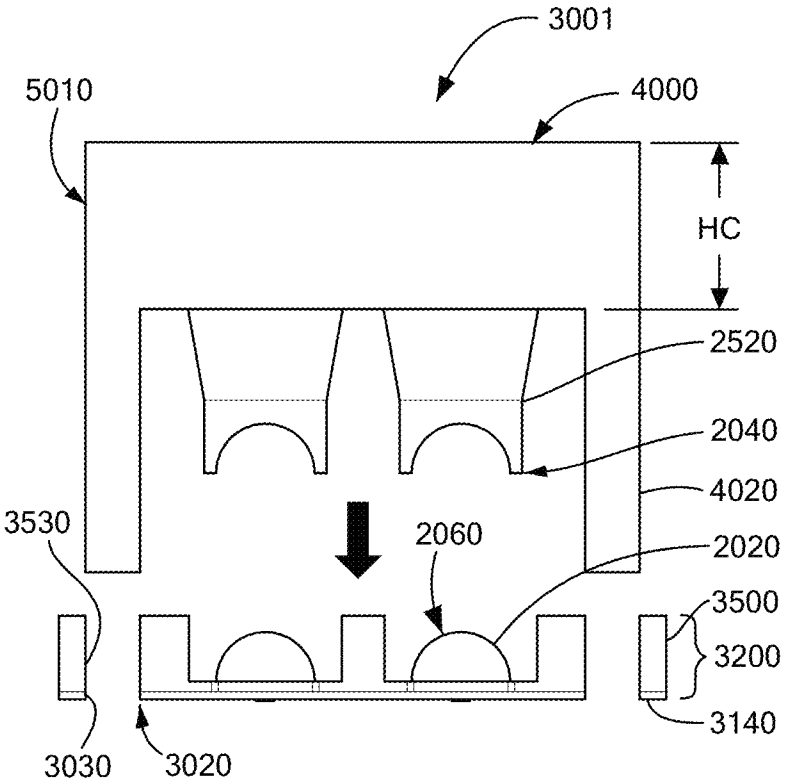
FIG. 5B depicts a side view of a disassembled assembly of the M×N array of FIG. 5A, in accordance with an embodiment.
Figure 5A:
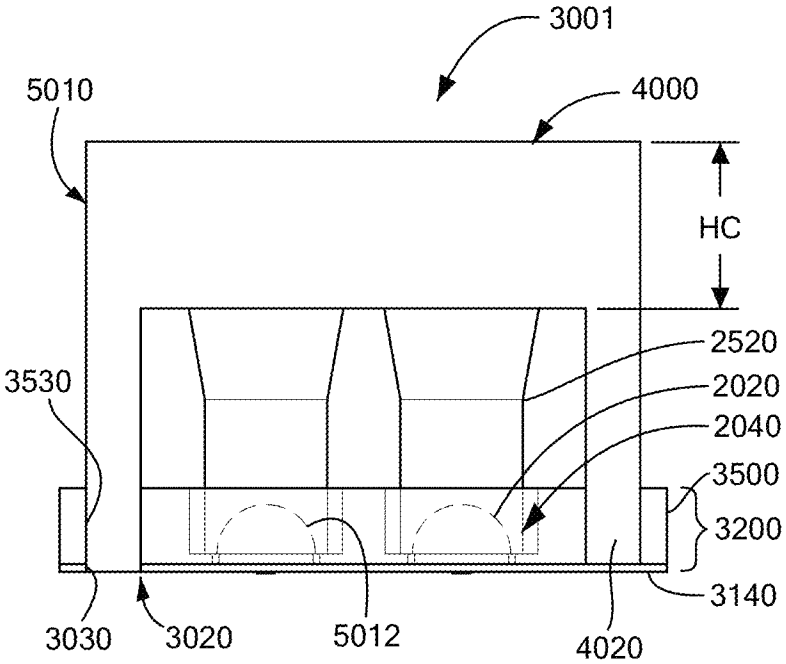
FIG. 5A depicts a side view of an M×N array, where M=2, of a plurality of unit cells of FIG. 1B, in accordance with an embodiment.

FIG. 5A depicts an M×N array 3001 where M=2 and N is unrestricted, similar to the array 3000 of FIG. 4, where the dielectric 3140 and the metal fence structure 3500 each have axially aligned through holes 3030, 3530, respectively, that define a location of the respective support portions 3020 of the substrate 3200, and the respective mount portions 4020 are disposed within the corresponding through holes 3030, 3530 of the dielectric 3140 and metal fence structure 3500, respectively. FIG. 5B depicts the array 3001 of FIG. 5A prior to assembly of the monolithic structure 5010, similar to monolithic structure 5000 described herein above, to the substrate 3200. As depicted, the array 3001 is a connected array having a connecting structure 4000, the lower Dk material of the second dielectric portion 2520 covers all sides of the higher Dk material of the first dielectric portion 2020, as depicted at the proximal end 2040 of the second dielectric portion 2520, and the second dielectric portion 2520 is in direct intimate contact with the first dielectric portion 2020, as depicted by dashed lines 5012 in FIG. 5A.

Figure 6B:
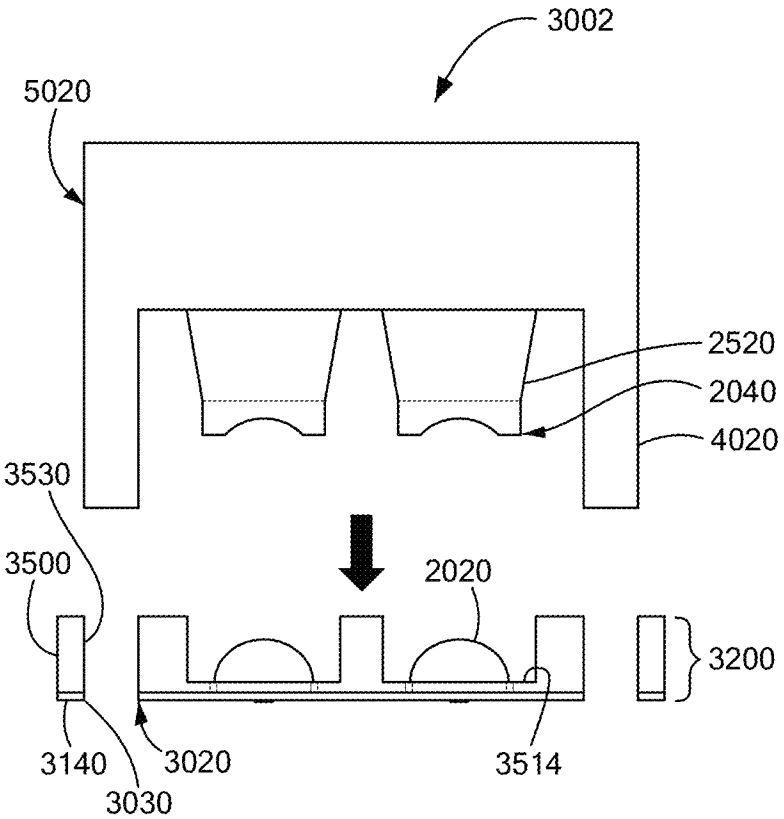
FIG. 6B depicts a side view of a disassembled assembly of the M×N array of FIG. 6A, in accordance with an embodiment.
Figure 6A:
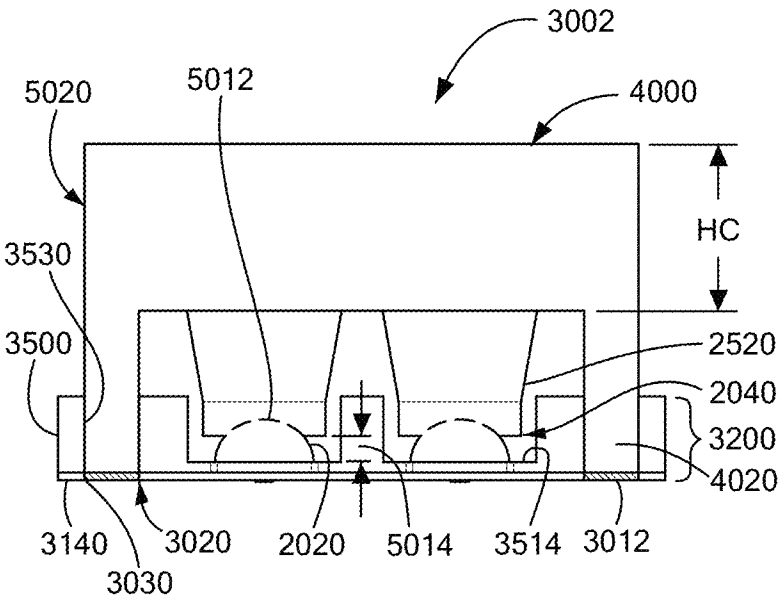
FIG. 6A depicts a side view of an M×N array, where M=2, of a plurality of unit cells similar but alternative to that of FIG. 5A, in accordance with an embodiment.

FIG. 6A depicts an M×N array 3002 where M=2 and N is unrestricted, similar to the array 3001 of FIG. 5A, where the dielectric 3140 and the metal fence structure 3500 each have axially aligned through holes 3030, 3530, respectively, that define a location of the at least one support portion 3020 of the substrate 3200, and the respective mount portions 4020 are disposed within the corresponding through holes 3530 of the metal fence structure 3500, but not the through holes 3030 the dielectric 3140. In an embodiment, the through holes 3030 of the dielectric 3140 are filled with a bonding material 3012, such as an adhesive, that secures the mount portions 4020 of the monolithic structure 5020, similar to monolithic structure 5010 depicted in FIG. 5A, to the substrate 3200. FIG. 6B depicts the array 3002 of FIG. 6A prior to assembly of the monolithic structure 5020 to the substrate 3200. As depicted, the array 3002 is a connected array having a connecting structure 4000, the lower Dk material of the second dielectric portion 2520 does not cover all sides of the higher Dk material of the first dielectric portion 2020, as depicted at the proximal end 2040 of the second dielectric portion 2520 where a gap 5014 is present between the proximal end 2040 of the second dielectric portion 2520 and the electrically conductive base 3514 of the metal fence structure 3500 upon which the first dielectric portion 2020 is disposed, and the second dielectric portion 2520 is in direct intimate contact with the first dielectric portion 2020, as depicted by dashed lines 5012 in FIG. 5A.

Figure 7A:
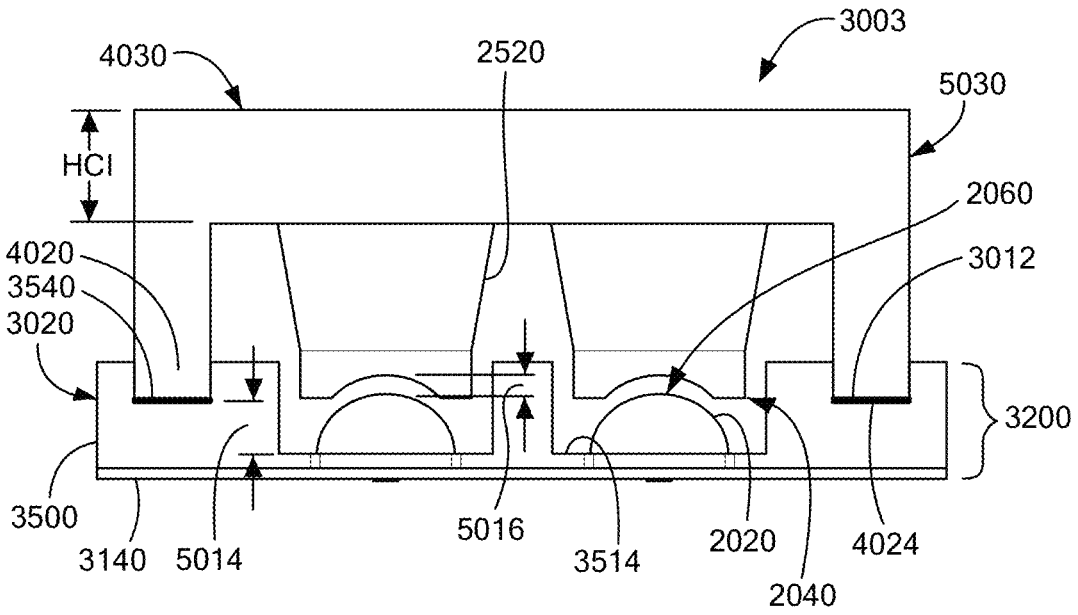
FIG. 7A depicts a side view of an M×N array, where M=2, of a plurality of unit cells similar but alternative to that of FIGS. 5A and 6A, in accordance with an embodiment.
Figure 7B:
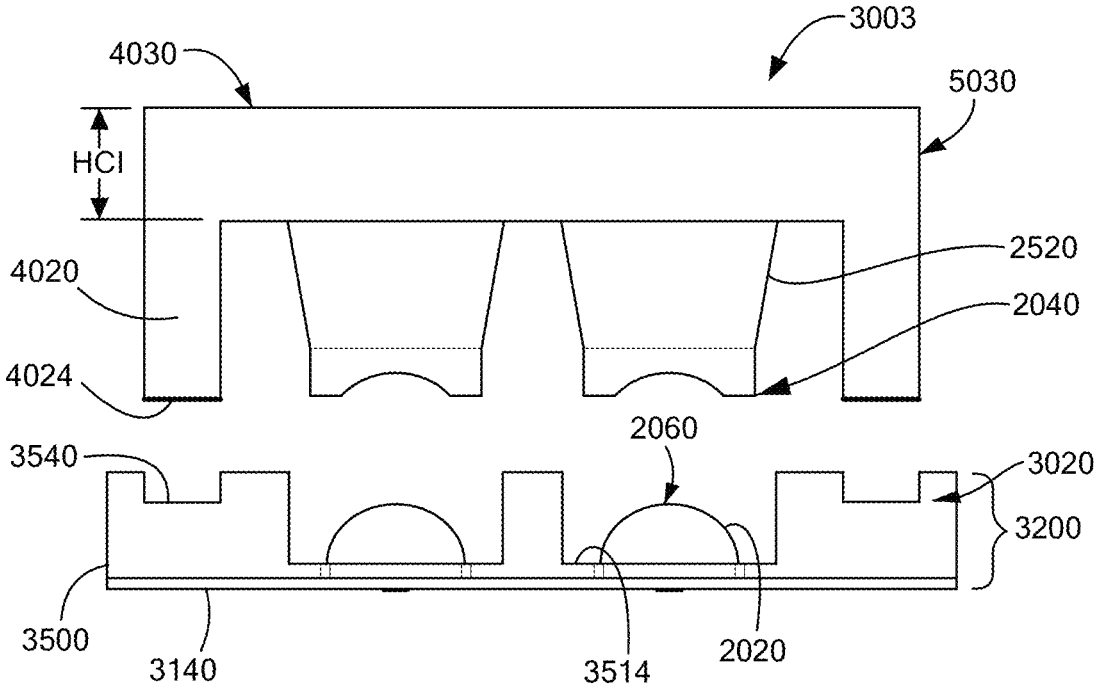
FIG. 7B depicts a side view of a disassembled assembly of the M×N array of FIG. 7A, in accordance with an embodiment.

FIG. 7A depicts an M×N array 3003 where M=2 and N is unrestricted, similar to the arrays 3001, 3002 of FIGS. 5A and 6A, respectively, but with some alternative features. As depicted in FIG. 7A, the dielectric 3140 is absent a through hole in the region of the mount portions 4020 of the connecting structure 4030, similar but alternative to connecting structure 4000, and the metal fence structure 3500 has recessed support surfaces 3540 upon which the mount portions 4020 are seated, forming the at least one support portion 3020. In an embodiment, a bonding material 3012 secures the mount portions 4020 of the monolithic structure 5030, similar to monolithic structures 5010, 5020, to the recessed support surfaces 3540. FIG. 7B depicts the array 3003 of FIG. 7A prior to assembly of the monolithic structure 5030 to the substrate 3200. Stated alternatively, each support portion 3020 of the substrate 3200 includes an upward facing support surface 3540, and each mount portion 4020 of the connecting structure 4030 includes a downward facing mount surface 4024 disposed in face-to-face engagement with a corresponding one of the upward facing support surface 3540.

As depicted, the array 3003 is a connected array having a connecting structure 4030, the lower Dk material of the second dielectric portion 2520 does not cover all sides of the higher Dk material of the first dielectric portion 2020, as depicted at the proximal end 2040 of the second dielectric portion 2520 where a gap 5014 is present between the proximal end 2040 of the second dielectric portion 2520 and the electrically conductive base 3514 of the metal fence structure 3500 upon which the first dielectric portion 2020 is disposed, and the second dielectric portion 2520 is disposed a distance away from the distal end 2060 of the first dielectric portion 2020, as depicted by gap 5016 in FIG. 7A. In comparing the connecting structure 4030 of FIG. 7A with the connecting structure 4000 of FIG. 5A, the connecting structure 4000 has a cross sectional overall height HC, and the connecting structure 4030 has a cross sectional overall height HC1, where HC1 is less than HC. In an embodiment, HC1 is equal to or less than one times λ, where λ is a freespace wavelength at an operating center frequency of the EM device 1000. Alternatively, in an embodiment, HC1 is equal to or less than one-half times λ. Alternatively, in an embodiment, HC1 is equal to or less than one-quarter times λ. Alternatively, in an embodiment, HC1 is equal to or less than one-fifth times λ. Alternatively, in an embodiment, HC1 is equal to or less than one-tenth times λ.

Figure 8A:
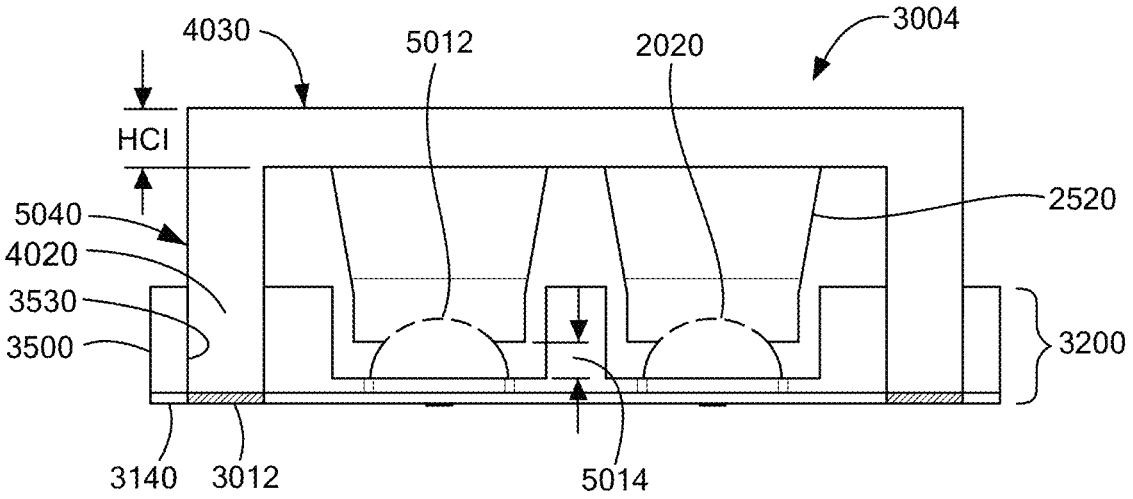
FIG. 8A depicts a side view of an M×N array, where M=2, of a plurality of unit cells similar but alternative to that of FIG. 6A, in accordance with an embodiment.

FIG. 8A depicts an M×N array 3004 where M=2 and N is unrestricted, similar to the array 3004 of FIG. 6A, but where the height of the connecting structure is HC1 as opposed to HC. Other like features in FIGS. 8 and 6A are numbered alike.

Figure 8B:
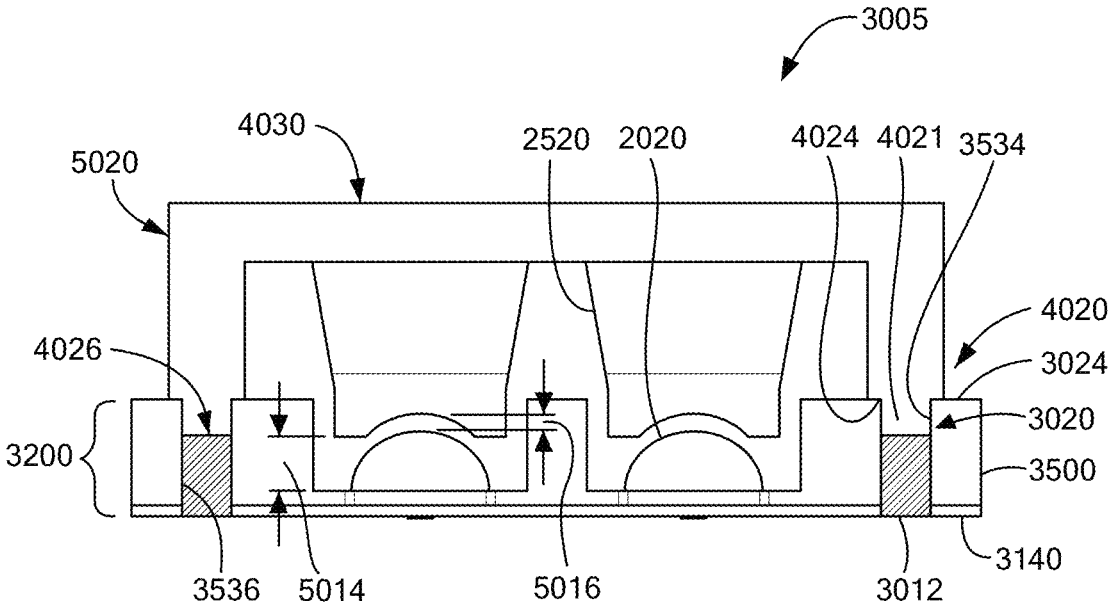
FIG. 8B depicts a side view of an M×N array, where M=2, of a plurality of unit cells similar but alternative to that of FIG. 7A, in accordance with an embodiment.

FIG. 8B depicts an M×N array 3005 where M=2 and N is unrestricted, similar to the combination of the array 3003 of FIG. 7A having gaps 5014 and 5016, and the array 3004 of 8A having bonding material 3012, but with alternative mount features. In an embodiment, each supporting portion 3020 of the substrate 3200 includes an upward facing shoulder 3024 formed in the metal fence structure 3500, and each mount portion 4020 of the monolithic structure 5020 includes a downward facing shoulder 4024 disposed on a corresponding one of the upward facing shoulder 3024, with a reduced cross section distal end 4026 of the mount portion 4020 that engages with an opening, or through hole, 3534 in the metal fence structure 3500. A void 3536 formed in the metal fence structure 3500 below the distal end 4026 of the mount portion 4020 is filled with the bonding material 3012 to secure the monolithic structure 5020 to the substrate 3200.

With reference to FIGS. 6A, 8A and 8B, it can be seen that an embodiment includes an arrangement where the corresponding mount portion 4020 is disposed only partially within a corresponding one of the through holes 3030, 3530, 3534 of the metal fence structure 3500, and a bonding material 3012 is disposed at least partially in the remaining through hole portions of the metal fence structure 3500 and the corresponding through holes of the substrate 3200.

With reference to FIG. 8B, it can be seen that an embodiment includes an arrangement where the mount portions 4020 of the connecting structure 4030 forms a post (referred to by reference numeral 4020) with a stepped-down post end 4021, and the stepped-down post end 4021 is disposed partially within the corresponding through hole 3534 of the metal fence structure 3500. In an embodiment, the post 4020 and the stepped-down post end 4021 are cylindrical.

Figure 9A:
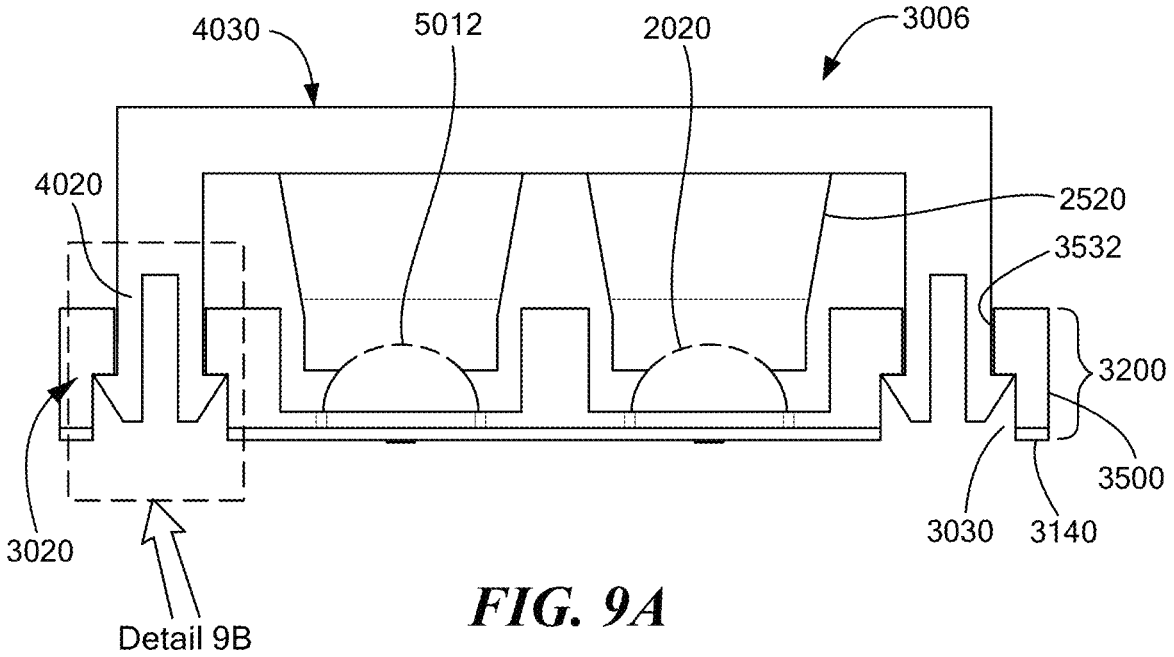
FIG. 9A depicts a side view of an M×N array, where M=2, of a plurality of unit cells similar but alternative to that of FIG. 8A, in accordance with an embodiment.
Figure 9B:
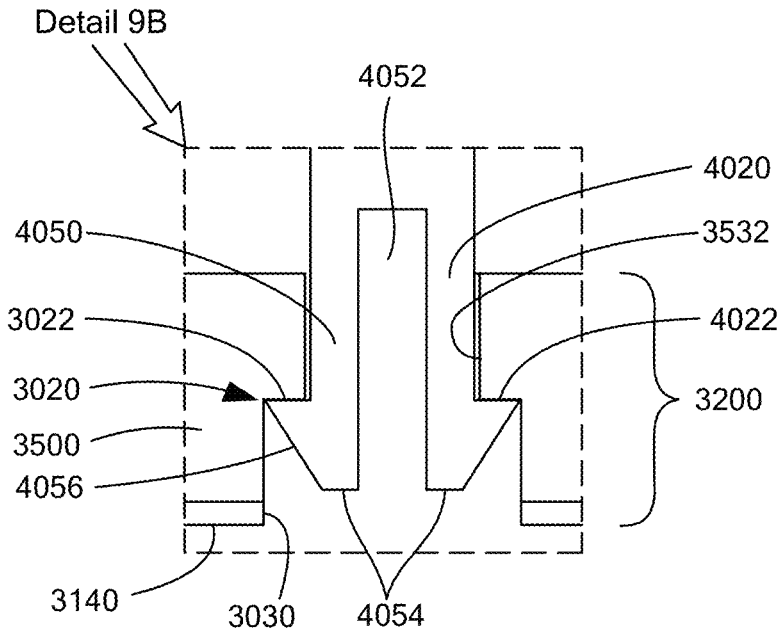
FIG. 9B depicts an enlarged view of Detail 9B of FIG. 9A.

FIG. 9A depicts an M×N array 3006 where M=2 and N is unrestricted, similar to the array 3004 of FIG. 8A, but with alternative mount features, and FIG. 9B Detail-9B shown in FIG. 9A. In an embodiment, each support portion 3020 of the substrate 3200 includes a downward facing undercut shoulder 3022 formed in the metal fence structure 3500, and each mount portion 4020 of the connecting structure 4030 includes an upward facing snap-fit shoulder 4022 disposed in snap-fit engagement with the corresponding downward facing undercut shoulder 3022 via an opening 3532 in the metal fence structure 3500. While FIGS. 9A and 9B depict a through holes 3030 in the dielectric 3140, it will be appreciated that such a through holes 3030 may not be necessary depending on the dimensions of the snap-fit leg 4050 of the connecting structure 4030. In an embodiment, the snap-fit leg 4050 includes an open central region 4052, which permits the side portions 4054 to flex inward to facilitate the aforementioned snap-fit engagement. A tapered nose 4056 on the distal end of the mount portion 4020 facilitates entry of the mount portion 4020 into the opening 3532.

Figure 10:
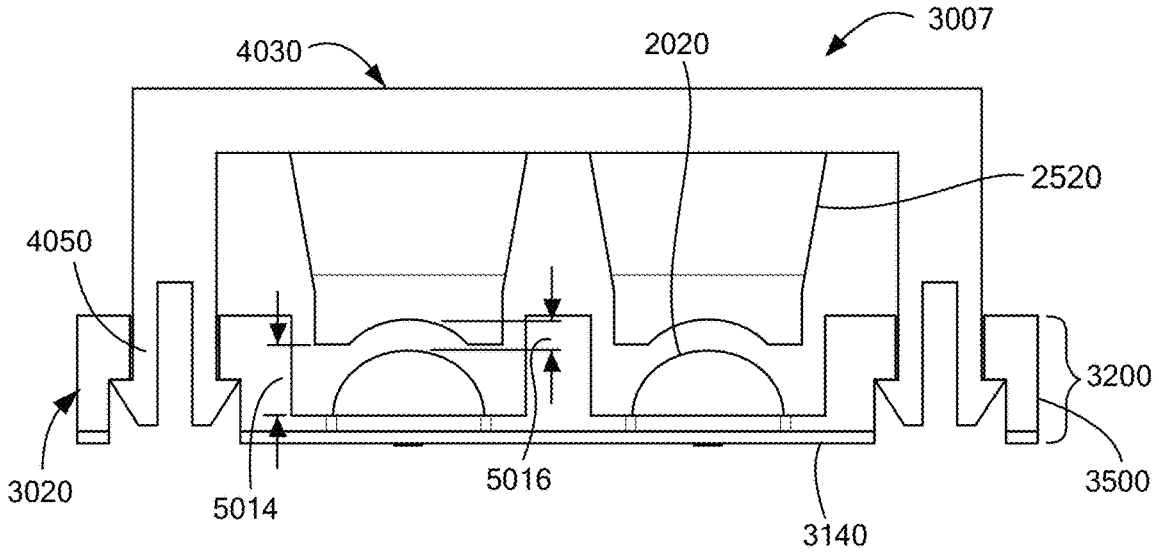
FIG. 10 depicts a side view of an M×N array, where M=2, of a plurality of unit cells similar but alternative to that of FIG. 9A, in accordance with an embodiment.

FIG. 10 depicts an M×N array 3007 where M=2 and N is unrestricted, which is similar to the combination of array 3003 of FIG. 7A having gaps 5014 and 5016, and array 3005 of FIG. 9A having snap-fit legs 4050. Other like features between FIGS. 10, 9A and 7A are numbered alike.

As can be seen by the foregoing descriptions of FIGS. 1-4 in combination with FIGS. 5A-10, many EM device features disclosed herein are interchangeable and usable with other EM device features disclosed herein. As such, it will be appreciated that while not all combinations of EM device features are illustrated and specifically described herein, one skilled in the art would appreciate that substitutions of one EM device feature for another EM device feature may be employed without detracting from the scope of an invention disclosed herein. Accordingly, any and all combinations of EM device features as disclosed herein are contemplated and considered to fall within the ambit of an invention disclosed herein.

Figure 11:
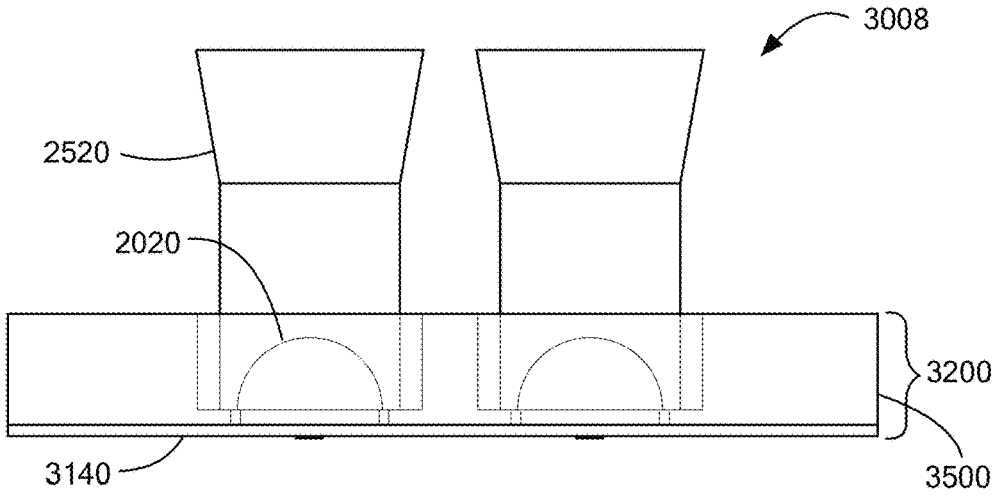
FIG. 11 depicts a side view of an M×N array, where M=2, of a plurality of unit cells similar but alternative to that of FIG. 5A, in accordance with an embodiment.
Figure 12:
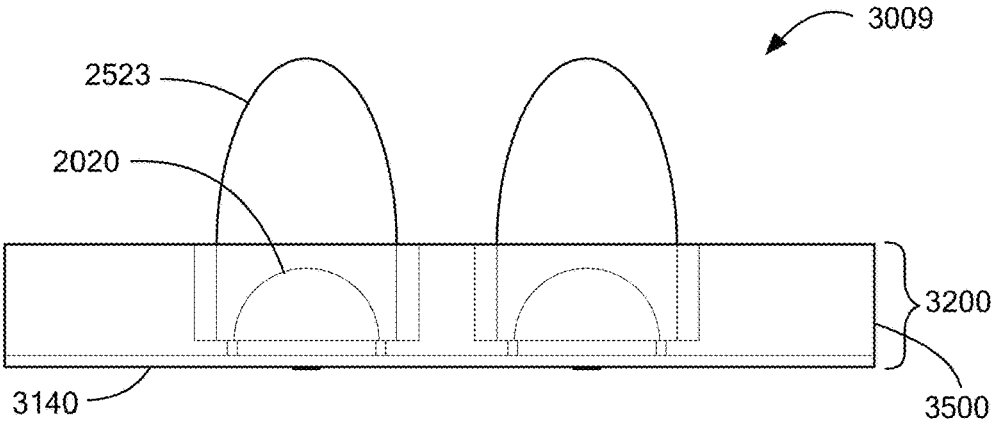
FIG. 12 depicts a side view of an M×N array, where M=2, of a plurality of unit cells similar but alternative to that of FIG. 11, in accordance with an embodiment.

Reference is now made to FIGS. 11-12.

FIG. 11 depicts an M×N array 3008 where M=2 and N is unrestricted, similar to the array 3001 of FIG. 5A, but absent the connecting structure 4000 depicted in FIG. 5A. Other like features between FIGS. 11 and 5A are numbered alike.

FIG. 12 depicts an M×N array 3009 where M=2 and N is unrestricted, similar to the array 3007 of FIG. 11, absent a connecting structure 4000, and having a second dielectric portion 2523 similar to that depicted in FIG. 3. Other like features between FIGS. 12 and 11 are numbered alike.

As can be seen by the foregoing descriptions and/or illustrations of FIGS. 1-12, embodiments of the invention may or may not include a connecting structure 4000, and still perform in accordance with an embodiment of an invention disclosed herein. As such, it is contemplated that any embodiment disclosed herein including a connecting structure may be employed absent such connecting structure, and any embodiment disclosed herein absent a connecting structure may be employed with such connecting structure.

Figure 13:
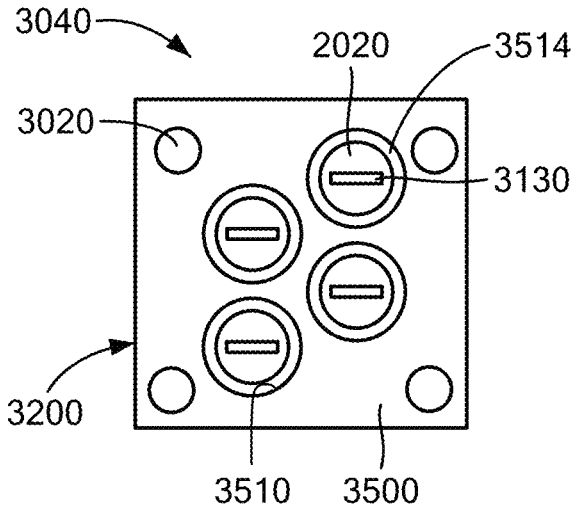
FIG. 13 depicts a plan view of an M×N array, where M=2 and N=2, of a plurality of first dielectric portions on a substrate, in accordance with an embodiment.
Figure 14A:
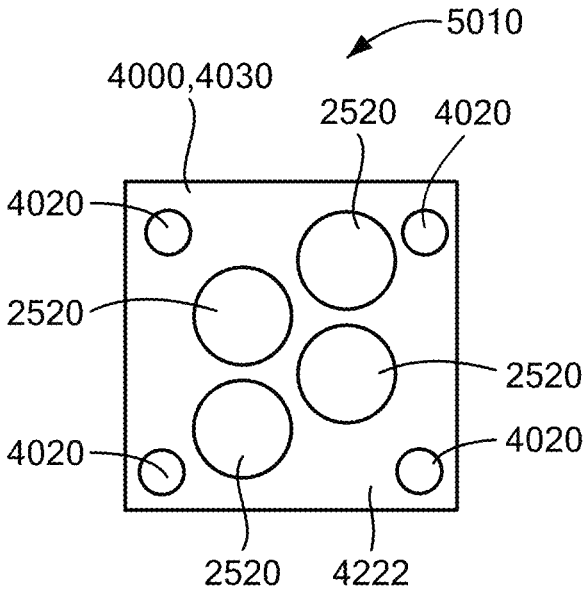
FIG. 14A depicts a plan view of a monolithic structure including an M×N array, where M=2 and N=2, of a plurality of second dielectric portions, and a plurality of mount portions, interconnected via a connecting structure, in accordance with an embodiment.
Figure 14B:
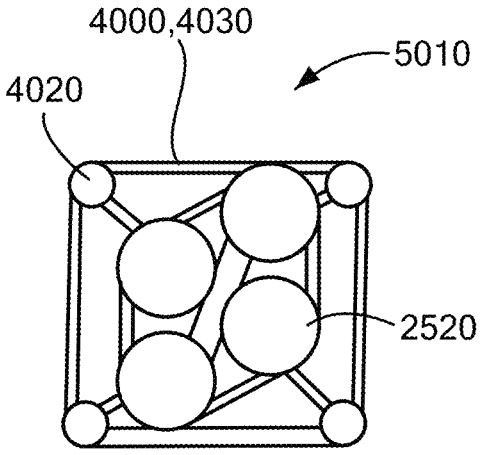
FIG. 14B depicts a plan view of a monolithic structure similar but alternative to that of FIG. 14A, in accordance with an embodiment.

Reference is now made to FIG. 13, which depicts an example plan view embodiment of M×N array 3040 where M=2 and N=2, but where the invention is not so limited to a 2×2 array. The array 3040 is representative of any of the foregoing arrays 3001, 3002, 3003, 3004, 3005, 3006, 3007, depicted in FIGS. 5A, 6A, 7A, 8A, 8B, 9A, 10, respectively, absent the corresponding second dielectric portion 2520, 2523, connecting structure 4000, 4030, and/or monolithic structure 5020. As depicted, the array 3040 includes the substrate 3200 with the metal fence structure 3500 having the electrically conductive electromagnetic reflectors 3510 and the electrically conductive base 3514 (the dielectric 3140 being hidden from view), the first dielectric portion 2020, a slotted feed aperture 3130 (which could be replaced with any of the foregoing feed structures), and support portions 3020. Reference is now made to FIG. 14A in combination with FIG. 13, where FIG. 14A depicts the monolithic structure 5010 prior to assembly to the substrate 3200. As depicted, the monolithic structure 5010 has a plurality of second dielectric portions 2520, a plurality of mount portions 4020, and the connecting structure 4000, 4030. While the connecting structure 4000, 4030 is illustrated as completely filling the space between the second dielectric portions 2520 and the mount portions 4020, it will be appreciated that this is for illustration purposes only, and that the connecting structure 4000, 4030 need only have connection branches that interconnect the second dielectric portions 2520 and the mount portions 4020 to form the monolithic structure 5010. See for example FIG. 14B depicting the same second dielectric portions 2520 and mount portions 4020 as those depicted in FIG. 14A, but with the connecting structure 4000, 4030 being a plurality of interconnected ribs, where the combination forms the monolithic structure 5010. A comparison between FIG. 14A and at least FIGS. 5A and 7A will show that the connecting structure 4000, 4030 is disposed at a distance away from the substrate 3200, which may be occupied by air or some non-gaseous dielectric material. Those portions of the monolithic structure 5010 that are disposed a distance away for the substrate 3200 are also herein referred to as a non-attachment zone 4222.

Figure 16:
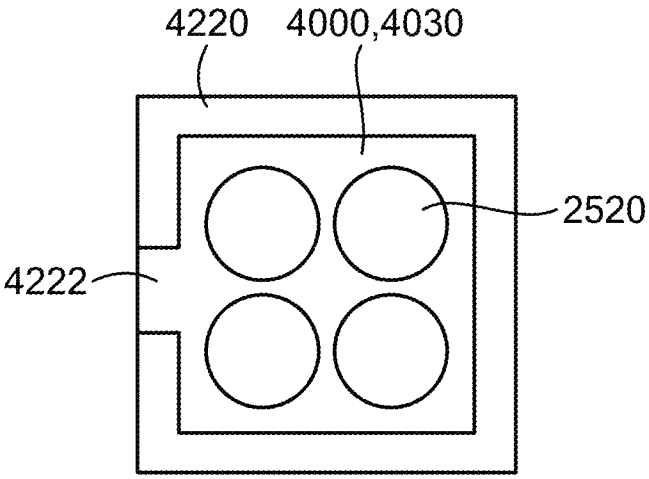
FIG. 16 depicts a plan view of a monolithic structure similar but alternative to that of FIGS. 14A-15, in accordance with an embodiment.
Figure 15:
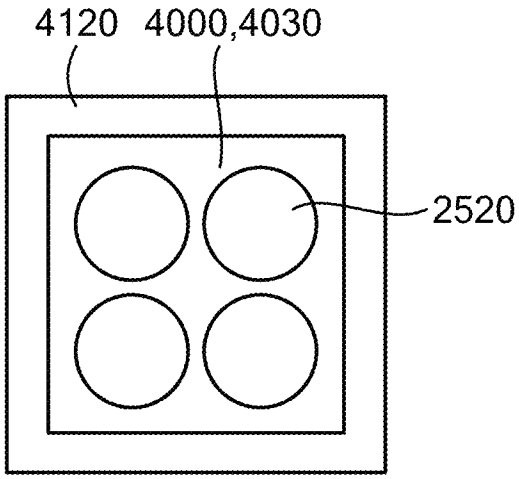
FIG. 15 depicts a plan view of a monolithic structure similar but alternative to that of FIGS. 14A-14B, in accordance with an embodiment.
Figure 18:
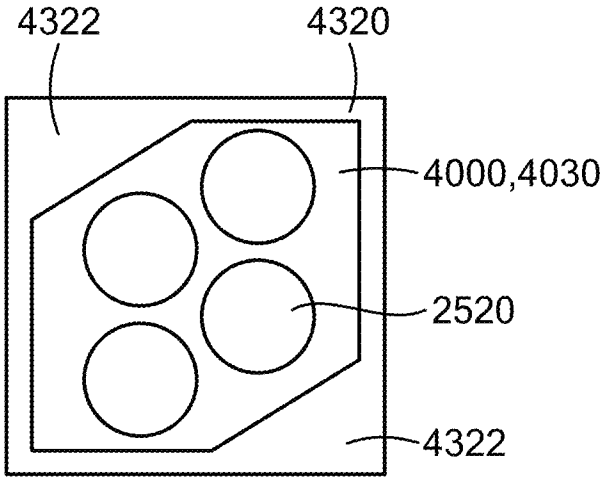
FIG. 18 depicts a plan view of a monolithic structure similar but alternative to that of FIGS. 14A-17, in accordance with an embodiment.
Figure 17:
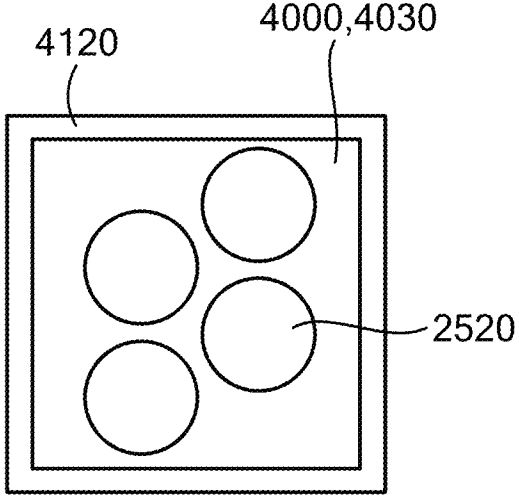
FIG. 17 depicts a plan view of a monolithic structure similar but alternative to that of FIGS. 14A-16, in accordance with an embodiment.
Figure 19:
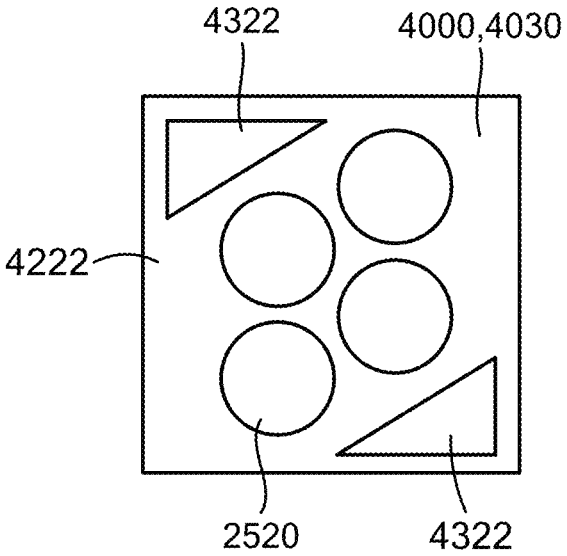
FIG. 19 depicts a plan view of a monolithic structure similar but alternative to that of FIGS. 14A-18, in accordance with an embodiment.
Figure 20:
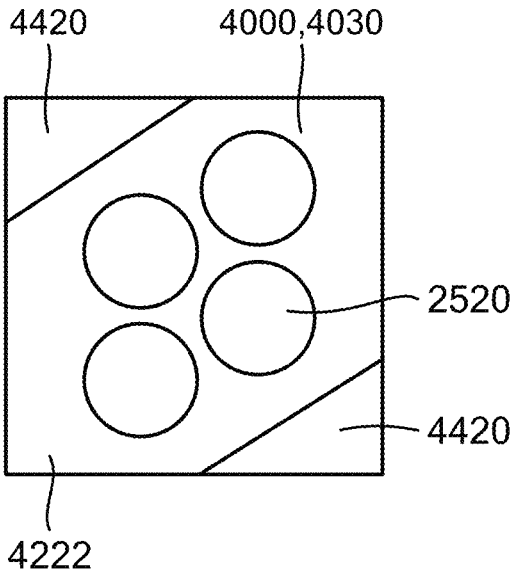
FIG. 20 depicts a plan view of a monolithic structure similar but alternative to that of FIGS. 14A-19, in accordance with an embodiment.
Figure 21:
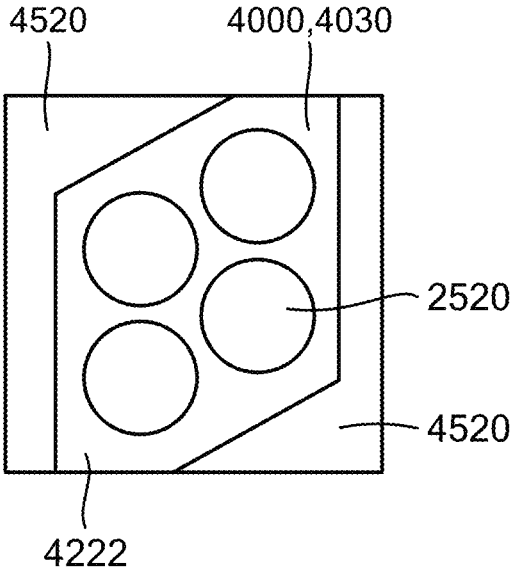
FIG. 21 depicts a plan view of a monolithic structure similar but alternative to that of FIGS. 14A-20, in accordance with an embodiment.

Reference is now made to FIGS. 15-21, which depict alternative arrangements for the mount portions 4020, the array layout of the dielectric structures 2000 where only the second dielectric portions 2520 of the dielectric structures 2000 are depicted in FIGS. 15-21, and the resulting connecting structure 4000, 4030. In FIG. 15 the second dielectric portions 2520 are arranged in a rectilinear layout, and the mount portions 4120 are arranged to completely surround the second dielectric portions 2520 (and the resulting dielectric structures 2000). In FIG. 16 the second dielectric portions 2520 are arranged in a rectilinear layout, and the mount portions 4220 are arranged to partially surround the second dielectric portions 2520, with at least one non-attachment region 4222 being present between the monolithic and the substrate. In FIG. 17 the second dielectric portions 2520 are arranged in a non-rectilinear layout, and the mount portions 4120 are arranged to completely surround the second dielectric portions 2520, similar to that of FIG. 15. In FIG. 18 the second dielectric portions 2520 are arranged in a non-rectilinear layout, and the mount portions 4320 are arranged to completely surround the second dielectric portions 2520, similar to that of FIGS. 15 and 17, but with additional thicker mount portions 4322 placed in strategic locations such as the corners of the array for example. In FIG. 19 the second dielectric portions 2520 are arranged in a non-rectilinear layout, and the mount portions 4322 are formed via the additional thicker mount portions 4322 depicted in FIG. 18 absent the surrounding mount portions 4320 depicted in FIG. 18, resulting in at least one non-attachment region 4222 being present between the monolithic and the substrate. In FIG. 20 the second dielectric portions 2520 are arranged in a non-rectilinear layout, and the mount portions 4420 are formed via the additional thicker mount portions 4322 depicted in FIG. 18 with just a portion of the surrounding mount portions 4320 depicted in FIG. 18, resulting in at least one non-attachment region 4222 being present between the monolithic and the substrate. In FIG. 21 the second dielectric portions 2520 are arranged in a non-rectilinear layout, and the mount portions 4520 are formed via the additional thicker mount portions 4322 depicted in FIG. 18 with additional portions of the surrounding mount portions 4320 depicted in FIG. 18, resulting in at least one non-attachment region 4222 being present between the monolithic and the substrate. The connecting structures 4000, 4030 of FIGS. 15-21 may be formed to interconnect the corresponding mount portions 4120, 4220, 4222, 4320, 4322, 4420, 4520 and the second dielectric portions 2520 in any manner consistent with the disclosure herein.

From the foregoing, it will be appreciated that an embodiment of the invention includes an EM device 1000 where each of the at least one support portion 3020 of the substrate 3200 and the corresponding one of the at least one mount portion 4020, 4120, 4220, 4222, 4320, 4322, 4420, 4520 of the connecting structure 4000, 4030 are attached to each other to define a first attachment zone 4020, 4120, 4220, 4222, 4320, 4322, 4420, 4520, each one of the first dielectric portions 2020 of the array 3000, 3001, 3002, 3003, 3004, 3005, 3006, 3007, 3008, 3009 and the substrate 3200 are attached to each other to define a second attachment zone (aggregate of contact regions between the first dielectric portions 2020 and the substrate 3200), and a zone between the single monolithic structure 5000, 5010 and the substrate 3200 that is other than the first attachment zone or the second attachment zone defines a non-attachment zone 4222. In an embodiment, the first attachment zone at least partially surrounds the second attachment zone. Alternatively in an embodiment, the first attachment zone completely surrounds the second attachment zone.

From the foregoing, it will be appreciated that there are many variations, too many to list exhaustively, for configuring the mount portions and connecting structures, as well as the layout of the dielectric structures, for providing an embodiment consistent with the disclosure herein. Any and all such arrangements consistent with the disclosure herein are contemplated and considered to fall within the scope of an invention disclosed herein.

Figure 22:
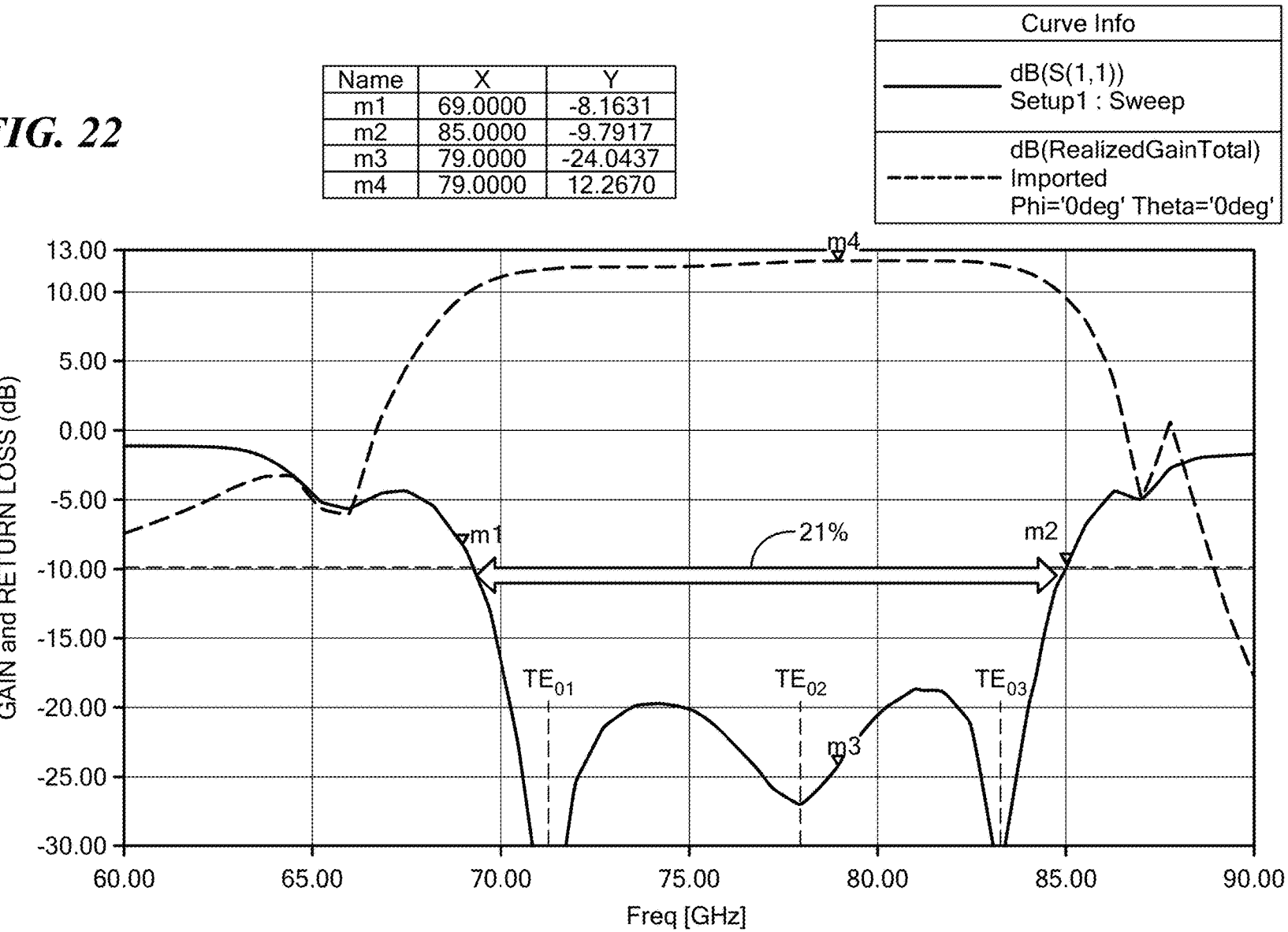
FIG. 22 depicts mathematical modeling performance characteristics a single unit cell, in accordance with an embodiment.
Figure 23:
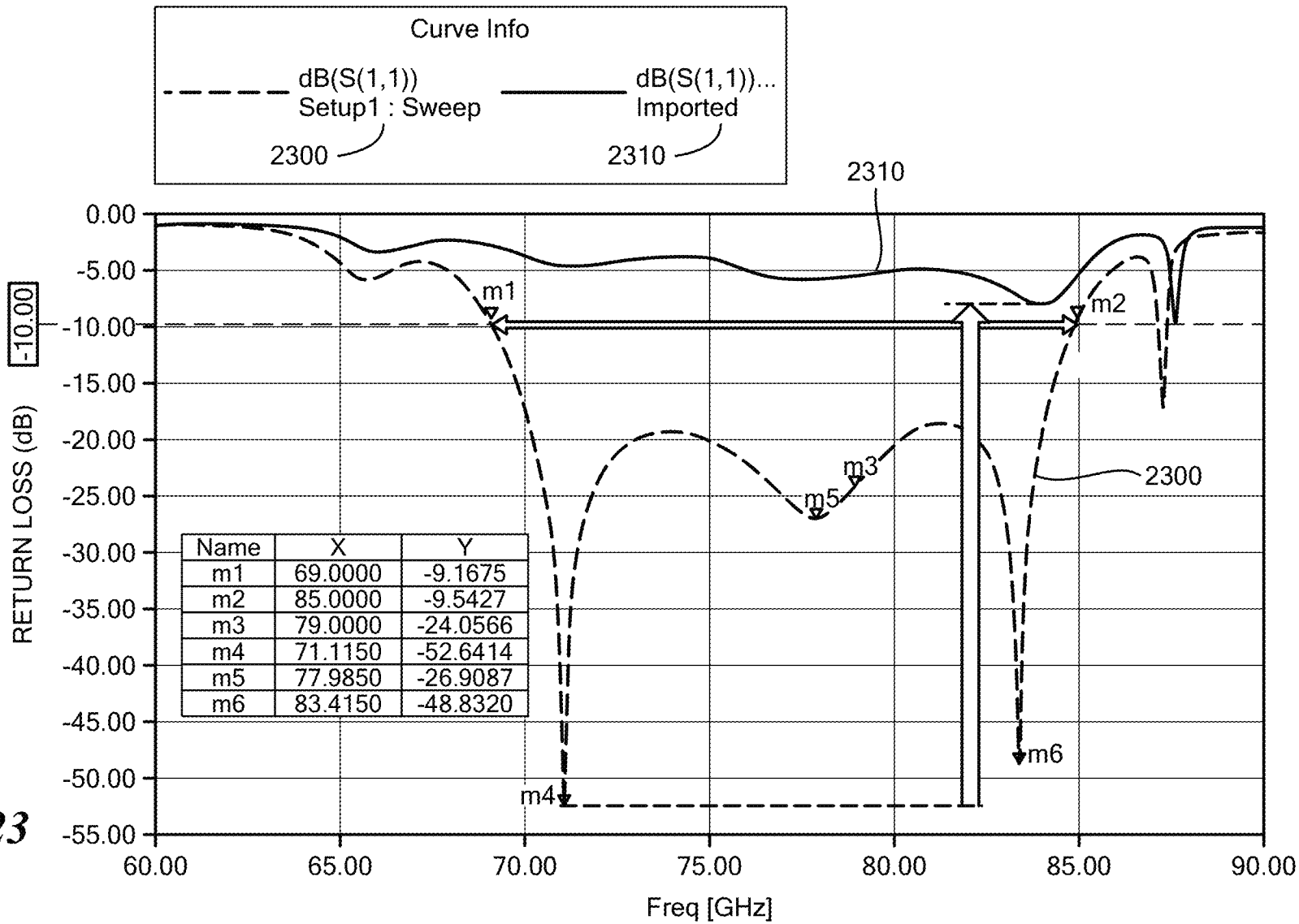
FIG. 23 depicts mathematical performance characteristics comparing the S(1, 1) return loss performance characteristics of a unit cell according to an embodiment, with a similar unit cell but absent an element according to the embodiment, in accordance with an embodiment.

Reference is now made to FIGS. 22-23, which illustrate mathematical modeling data showing the advantages of an example embodiment disclosed herein and generally represented by FIGS. 7A, 13 and 14A. FIG. 22 depicts the performance characteristics, more particularly the dBi gain and S(1, 1) return loss, for a single radiating dielectric structure 2000, more particularly a single unit cell 1020, having both the first dielectric portion 2020 and the second dielectric portion 2520 of an embodiment disclosed herein. As depicted, the bandwidth is 21% at −10 dBi between 69 GHz and 85 GHz, the gain is substantially constant with a peak of 12.3 dBi at 79 GHz in the 21% bandwidth, and three of the resonant modes in the 21% bandwidth are TE modes, $TE_{01}$, $TE_{02}$, $TE_{03}$. FIG. 23 depicts a comparison of the S(1, 1) return loss performance characteristics of the same unit cell 1020 as that associated with FIG. 22, with and without the second dielectric portion 2520, which is presented to illustrate the advantages of an embodiment disclosed herein. Curve 2300 depicts the S(1, 1) characteristic with the second dielectric portion 2520, and curve 2310 depicts the S(1, 1) characteristic absent the second dielectric portion 2520. As can be seen, use of the second dielectric portion 2520 enhances the minimum return loss by at least 40 dBi over the operating frequency range from 69 GHz to 85 GHz.

In view of the foregoing, it will be appreciated that an EM device 1000 as disclosed herein is operable having an operating frequency range having at least two resonant modes at different center frequencies, where at least one of the resonant modes is supported by the presence of the second dielectric portion 2520. In an embodiment, the at least two resonant modes are TE modes. It will also be appreciated that an EM device 1000 as disclosed herein is operable having an operating frequency range having at least three resonant modes at different center frequencies, where at least two of the at least three resonant modes are supported by the presence of the second dielectric portion 2520. In an embodiment, the at least three resonant modes are TE modes. In an embodiment, the EM device 1000 is operable having a minimum return loss value in an operating frequency range, and wherein removal of the second dielectric portion 2520 increases the minimum return loss value in the operating frequency range by at least 5 dBi, alternatively by at least 10 dBi, alternatively by at least 20 dBi, alternatively by at least 30 dBi, and further alternatively by at least 40 dBi.

In view of all of the foregoing, while certain combinations of EM device features have been described herein, it will be appreciated that these certain combinations are for illustration purposes only and that any combination of any of the EM device features disclosed herein may be employed in accordance with an embodiment of the invention. Any and all such combinations are contemplated herein and are considered to fall within the ambit of an invention disclosed herein.

With reference back to FIGS. 1C, 1D and at least FIG. 4, it will be appreciated that an embodiment includes a second dielectric portion 2550, alternatively herein referred to as an electromagnetic (EM) dielectric lens, having at least one lens portion (also herein referred to by reference numeral 2550) formed of at least one dielectric material, where the at least one lens portion 2550 has a cavity 2700 outlined by the boundary of the at least one dielectric material. In an embodiment, the at least one lens portion 2550 is formed from a plurality of layered lens portions (depicted by dashed lines 2552. In an embodiment, the plurality of lens portions 2550, 2552 are arranged in an array (see array 3000 in FIG. 4 for example). In an embodiment, the plurality of lens portions 2550, 2552 are connected (see connecting structure 4000 in FIG. 4 for example), where connection of the plurality of lens portions 2550, 2552 is provided by at least one dielectric material. In an embodiment, the EM dielectric lens 2550 is an all-dielectric structure.

In view of the foregoing description of structure of an EM device 1000 as herein disclosed, it will be appreciated that an embodiment also includes a method of making such EM device 1000, which includes: providing a substrate; disposing a plurality of first dielectric portions, FDPs, on the substrate, each FDP of the plurality of FDPs having a proximal end and a distal end and comprising a dielectric material other than air, the proximal end of each FDP being disposed on the substrate; disposing a second dielectric portion, SDP, proximate each FDP, each SDP having a proximal end and a distal end, the proximal end of each SDP being disposed proximate the distal end of a corresponding FDP, each SDP comprising a dielectric material other than air, the dielectric material of each FDP having an average dielectric constant that is greater than the average dielectric constant of the dielectric material of a corresponding SDP, each FDP and corresponding SDP forming a dielectric structure. In an embodiment of the method, each SDP is physically connected to at least one other of the SDPs via a connecting structure formed of a non-gaseous dielectric material, the connecting structure and the connected SDPs forming a single monolithic structure. In an embodiment of the method, the disposing a SDP includes disposing the single monolithic structure proximate each FDP. In an embodiment of the method, the single monolithic structure is a single dielectric material having a seamless and contiguous structure. In an embodiment of the method, the method further includes attaching the single monolithic structure to the substrate. In an embodiment of the method, the attaching includes attaching via bonding, posts of the single monolithic structure onto support platforms of the substrate. In an embodiment of the method, the attaching includes attaching via snap-fitting, snap-fit posts of the single monolithic structure into shouldered holes of the substrate. In an embodiment of the method, the attaching includes attaching stepped-down posts of the single monolithic structure only partially into through holes of the substrate, and applying a bonding material in the through holes to bond the posts to the substrate. In an embodiment of the method, the dielectric structure is an all-dielectric structure.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element such as a layer, film, region, substrate, or other described feature is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

The invention claimed is:

1. An electromagnetic device, comprising:

a dielectric structure that forms at least part of a dielectric resonator antenna, comprising:

a first dielectric portion, FDP, having a proximal end and a distal end, the FDP comprising a dielectric material other than air; and a second dielectric portion, SDP, having a proximal end and a distal end, the proximal end of the SDP being disposed proximate the distal end of the FDP, the SDP comprising a dielectric material other than air; and wherein the dielectric material of the FDP has an average dielectric constant that is greater than the average dielectric constant of the dielectric material of the SDP;

wherein the dielectric resonator antenna is operable having an operating frequency range comprising at least two resonant modes at different center frequencies, wherein at least one of the resonant modes is supported by the presence of the SDP.

2. The device of claim 1, wherein the dielectric structure is an all-dielectric structure.

3. The device of claim 1, wherein the FDP is a single dielectric material.

4. The device of claim 1, wherein the SDP comprises an outer body and an inner region, the outer body comprising a dielectric material having a first dielectric constant, and the inner region comprising a dielectric material having a second dielectric constant that is less than the first dielectric constant.

5. The device of claim 4, wherein the inner region comprises air.

6. The device of claim 1, wherein:

the SDP has an overall maximum height, HS, and an overall maximum width, WS; and HS is greater than WS.

7. The device of claim 1, wherein the SDP is disposed in direct intimate contact with the FDP.

8. The device of claim 1, wherein the SDP is disposed at a distance from the distal end of the FDP that is: equal to or less than five times λ, where λ is a freespace wavelength at an operating center frequency; equal to or less than three times λ; equal to or less than two times λ; equal to or less than one times λ; equal to or less than one-half times λ; or, equal to or less than one-tenth times λ.

9. The device of claim 1, wherein:

dielectric material of the FDP has a dielectric constant: equal to or greater than 10; equal to or greater than 11; equal to or greater than 12; equal to or greater than 10 and equal to or less than 20; or, equal to or greater than 10 and equal to or less than 15; and dielectric material of the SDP has a dielectric constant: equal to or less than 9; equal to or less than 5; equal to or less than 3; equal to or greater than 2 and equal to or less than 9; or equal to or greater than 2 and equal to or less than 5.

10. The device of claim 6, wherein HS is: equal to or greater than 1.5 times WS; or, equal to or greater than 2 times WS.

11. The device of claim 6, wherein the FDP has an overall maximum height, HF, and an overall maximum width, WF; and HS is greater than HF, or greater than 5 times HF: and WS is greater than WF, or greater than 1.2 times WF.

12. The device of claim 1, wherein:

the FDP comprises a convex distal end; and the SDP comprises a planar distal end, or a convex distal end.

13. The device of claim 1, comprising a plurality of the dielectric structures arranged in an array, wherein:

each SDP of the plurality of dielectric structures is physically connected to at least one other of the SDPs via a connecting structure.

14. The device of claim 13, wherein each connecting structure is relatively thin as compared to an overall outside dimension of one of the plurality of dielectric structures, each connecting structure having a cross sectional overall height that is less than an overall height of a respective connected dielectric structure and being formed of non-gaseous dielectric material, each connecting structure and the associated SDP forming a single monolithic structure.

15. The device of claim 14, wherein:

each connecting structure has a cross sectional overall height that is less than a free space wavelength of a corresponding operating center frequency at which the device is operational.

16. The device of claim 13, wherein:

the connecting structure is formed of a dielectric material that is the same as the dielectric material of the SDPs.

17. The device of claim 13, wherein:

the connecting structure and the SDPs form the single monolithic structure as a contiguous seamless structure.

18. The device of claim 13, wherein:

each of the SDPs are disposed at a distance from the distal end of a corresponding one of the FDPs with a defined gap therebetween.

19. The device of claim 13, wherein:

(i): each of the at least one support portion of the substrate comprises a downward facing undercut shoulder; and each of the at least one mount portion of the connecting structure comprises an upward facing snap-fit shoulder disposed in snap-fit engagement with the corresponding downward facing undercut shoulder; or (ii): each of the at least one support portion of the substrate comprises an upward facing support surface; and each of the at least one mount portion of the connecting structure comprises an downward facing mount surface disposed in face-to-face engagement with a corresponding one of the upward facing support surface.

20. The device of claim 19, wherein each of the at least one mount portion is adhered to a corresponding one of the at least one support portion.

21. The device of claim 13, wherein:

each one of the at least one support portion of the substrate and the corresponding one of the at least one mount portion of the connecting structure are attached to each other to define a first attachment zone;

each one of the FDPs of the array and the substrate are attached to each other to define a second attachment zone; and a zone between the single monolithic structure and the substrate that is other than the first attachment zone or the second attachment zone defines a non-attachment zone.

22. The device of claim 21, wherein:

the first attachment zone at least partially surrounds the second attachment zone, or the first attachment zone completely surrounds the second attachment zone.

23. The device of claim 1, wherein the at least two resonant modes are TE modes.

24. The device of claim 1, wherein the dielectric resonator antenna is operable having an operating frequency range comprising at least three resonant modes at different center frequencies, wherein at least two of the at least three resonant modes are supported by the presence of the SDP.

25. The device of claim 24, wherein the at least three resonant modes are TE modes.

26. The device of claim 1, wherein the dielectric resonator antenna is operable having a minimum return loss value in an operating frequency range, and wherein removal of the SDP increases the minimum return loss value in the operating frequency range by: at least 5 dB; at least 10 dB; at least 20 dB; at least 30 dB; or, at least 40 dB.

27. An electromagnetic device, comprising:

a dielectric structure comprising:

a first dielectric portion, FDP, having a proximal end and a distal end, the FDP comprising a dielectric material other than air; and a second dielectric portion, SDP, having a proximal end and a distal end, the proximal end of the SDP being disposed proximate the distal end of the FDP, the SDP comprising a dielectric material other than air;

wherein the dielectric material of the FDP has an average dielectric constant that is greater than the average dielectric constant of the dielectric material of the SDP; and wherein the SDP has a 3D shape having a first x-y plane cross-section area proximate the proximal end of the SDP, and a second x-y plane cross-section area between the proximal end and the distal end of the SDP, the second x-y plane cross section area being greater than the first x-y plane cross-section area.

28. An electromagnetic device, comprising:

a dielectric structure comprising:

a first dielectric portion, FDP, having a proximal end and a distal end, the FDP comprising a dielectric material other than air; and a second dielectric portion, SDP, having a proximal end and a distal end, the proximal end of the SDP being disposed proximate the distal end of the FDP, the SDP comprising a dielectric material other than air;

wherein the dielectric material of the FDP has an average dielectric constant that is greater than the average dielectric constant of the dielectric material of the SDP;

wherein the proximal end of the SDP has an overall maximum width W1, and the distal end of the SDP has an overall maximum width WS; and WS is greater than W1.

29. An electromagnetic device, comprising:

a plurality of dielectric structures arranged in an array, each dielectric structure of the plurality of dielectric structures comprising:

a first dielectric portion, FDP, having a proximal end and a distal end, the FDP comprising a dielectric material other than air; and a second dielectric portion, SDP, having a proximal end and a distal end, the proximal end of the SDP being disposed proximate the distal end of the FDP, the SDP comprising a dielectric material other than air; and wherein the dielectric material of the FDP has an average dielectric constant that is greater than the average dielectric constant of the dielectric material of the SDP;

wherein each SDP of the plurality of dielectric structures is physically connected to at least one other of the SDPs via a connecting structure;

further comprising a substrate upon which the array of dielectric structures are disposed, the substrate comprising at least one support portion, wherein the connecting structure comprises at least one mount portion, each of the at least one mount portion being disposed in one-to-one corresponding relationship with the at least one support portion.

30. The device of claim 29, wherein:

the substrate comprises a metal fence structure comprising a plurality of electrically conductive electromagnetic reflectors, each of the plurality of reflectors being disposed in one-to-one relationship with corresponding ones of the plurality of dielectric structures and being disposed substantially surrounding each corresponding one of the plurality of dielectric structures.

31. The device of claim 30, wherein:

the metal fence structure is a unitary metal fence structure; and the plurality of electrically conductive electromagnetic reflectors are integrally formed with the unitary metal fence structure.

32. The device of claim 30, wherein the substrate and the metal fence structure each comprise axially aligned through holes that define a location of the at least one support portion of the substrate.

33. The device of claim 30, wherein:

each of the at least one mount portion is disposed only partially within a corresponding one of the through holes of the metal fence structure; and a bonding material is disposed at least partially in the remaining through hole portions of the metal fence structure and the corresponding through holes of the substrate.

34. The device of claim 30, wherein:

each of the at least one mount portion of the connecting structure forms a post with a stepped-down post end; and the stepped-down post end is disposed partially within the corresponding one of the through holes of the metal fence structure.

35. The device of claim 34, wherein at least one of the post and the stepped-down post end are cylindrical.

* * * * *